US007076186B1

(12) United States Patent
Michlin et al.

(10) Patent No.: US 7,076,186 B1
(45) Date of Patent: Jul. 11, 2006

(54) TEAR-STRIP SEAL AND TEAR-SEAL ASSEMBLY USING A PRE-CUT TEAR INITIALIZATION AND A TONER HOPPER, TONER CARTRIDGE AND IMAGE FORMING APPARATUS USING SAME AND METHOD OF MANUFACTURING SAME SEAL, TONER HOPPER AND TONER CARTRIDGE ASSEMBLY

(75) Inventors: Steven Bruce Michlin, 6771 Cottonwood Knoll, West Bloomfield, MI (US) 48322; Jeffrey Byron Anderson, Scottsdale, AZ (US)

(73) Assignee: Steven Bruce Michlin, West Bloomfield, MI (US)

( * ) Notice: Subject to any disclaimer, the term of this patent is extended or adjusted under 35 U.S.C. 154(b) by 0 days.

(21) Appl. No.: 10/336,071

(22) Filed: Jan. 3, 2003

Related U.S. Application Data

(63) Continuation of application No. 08/370,968, filed on Jan. 10, 1995, now Pat. No. 6,552,780.

(51) Int. Cl.
*G03G 15/00* (2006.01)

(52) U.S. Cl. ..... 399/106; 399/111; 399/120

(58) Field of Classification Search ..... 399/103, 399/105, 106, 98, 102, 120, 111; 428/40.1, 428/41.7, 42.1, 114
See application file for complete search history.

(56) References Cited

U.S. PATENT DOCUMENTS 4,895,104 A * 1/1990 Yoshino et al. ..... 399/106
4,958,197 A * 9/1990 Kinashi et al. ..... 399/350
5,110,646 A * 5/1992 Prestel et al. ..... 428/43
5,177,540 A * 1/1993 Honda et al. ..... 399/106
5,184,182 A * 2/1993 Michlin ..... 399/262
5,282,003 A * 1/1994 Michlin ..... 399/103
5,337,126 A * 8/1994 Michlin ..... 399/262
5,523,828 A 6/1996 De Kesel ..... 399/103
5,752,131 A * 5/1998 Fujiwara et al. ..... 399/106
5,781,831 A 7/1998 Matsuzaki et al. ..... 399/119

(Continued)

FOREIGN PATENT DOCUMENTS

GB 2292469 * 2/1996

(Continued)

*Primary Examiner*—Hoan Tran

(57) ABSTRACT

An improved seal-insert and seal for a toner hopper as used in toner cartridge assemblies for printers, copiers and facsimile machines. In one embodiment, the seal has two slotted, rectangular outer pieces joined together with slot alignment and joined by an inner layer of two-sided tape. The two-sided tape is made with a long u-shape which does not interfere with the slots in the outer pieces. The open end of the u-shaped tape configuration allows a seal to be inserted or removed from between the outer pieces to close or open the slots. The seal-insert is applied over the passage from the toner hopper. The outer pieces are made from an antistatic and/or a conductive material, such as an aluminum laminate or plastic imprefnated with conductive particles. Alternately, the outer pieces may be made from plastic covered with an antistatic and/or conductive spray or coating. In another embodiment, a tear-seal is made from antistatic and/or conductive material, and is provided with a tear-guide secured to and under the tear-sheet. The tear-guide has a width smaller than the tear-sheet and slightly smaller than the slot of the seal-insert. When the tear-guide is pulled by the enduser, the tear-guide will rip the tear-sheet in a straight line, providing an opening with an even width that will not block toner flow.

133 Claims, 11 Drawing Sheets

U.S. PATENT DOCUMENTS

| | | | | |
|---|---|---|---|---|
| 5,909,606 | A * | 6/1999 | Fujiwara | 399/106 |
| 6,118,958 | A * | 9/2000 | Nagashima | 399/105 |
| 6,552,780 | B1 * | 4/2003 | Michlin et al. | 399/106 |
| 2001/0033909 | A1 * | 10/2001 | Cornelius et al. | 428/114 |

FOREIGN PATENT DOCUMENTS

| | | | |
|---|---|---|---|
| JP | 55-90979 | * | 7/1980 |
| JP | 1-315779 | * | 12/1989 |
| JP | 4-179976 | * | 6/1992 |
| JP | 4353435 | * | 12/1992 |
| JP | 7-56428 | * | 3/1995 |
| JP | 7-168428 | * | 7/1995 |
| JP | 8-305163 | * | 11/1996 |
| JP | 2002-351201 | * | 12/2002 |

* cited by examiner

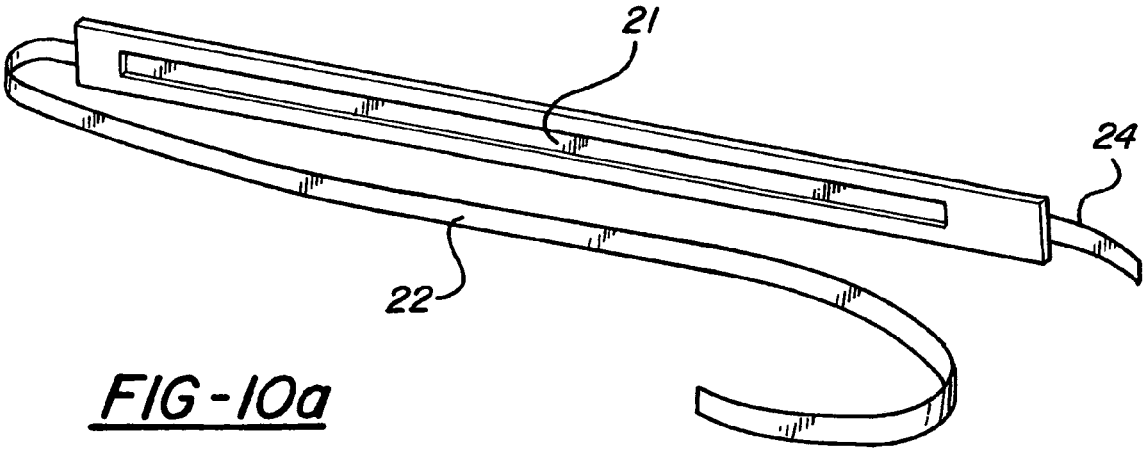
FIG-10a
FIG-10b
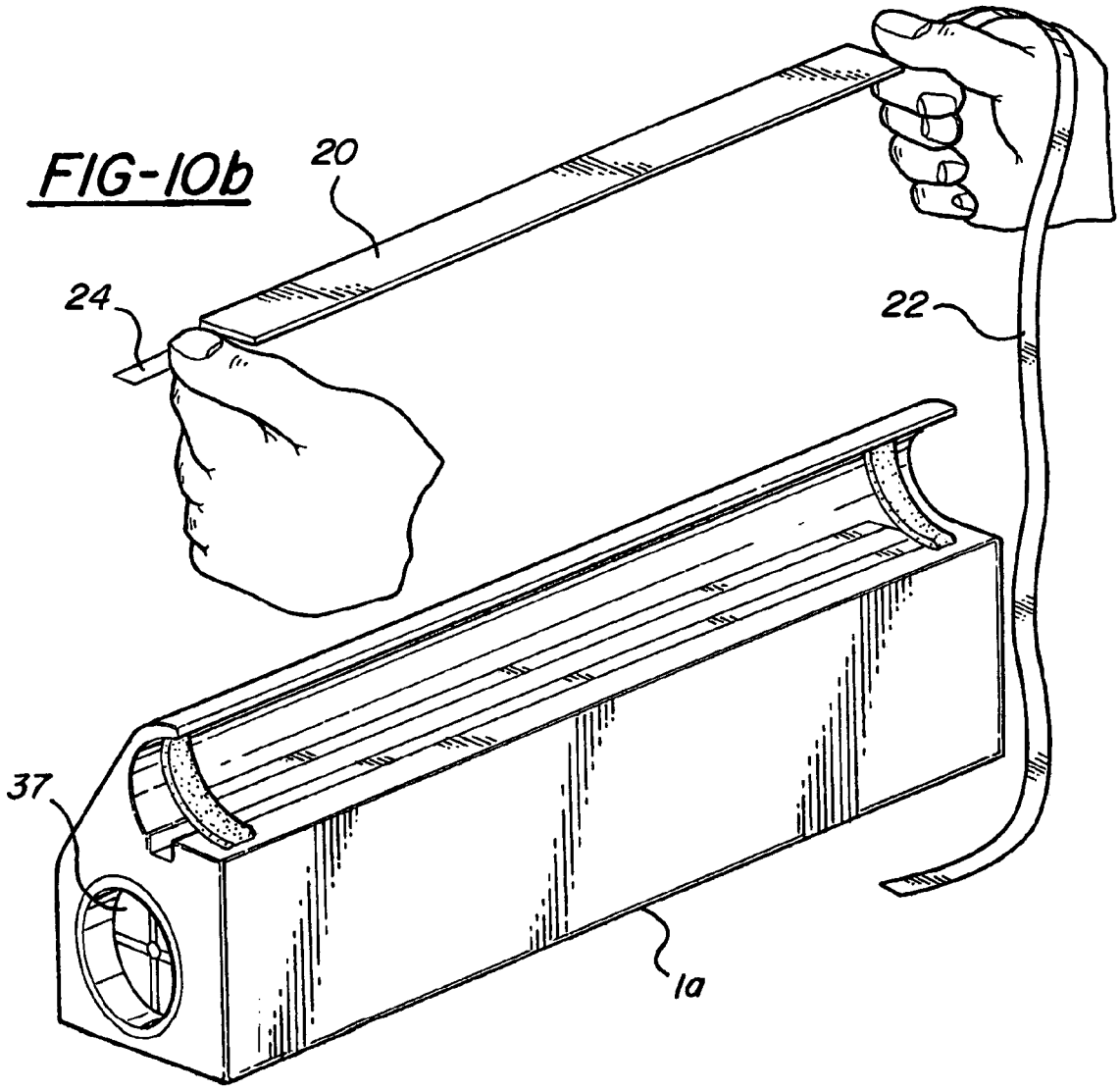

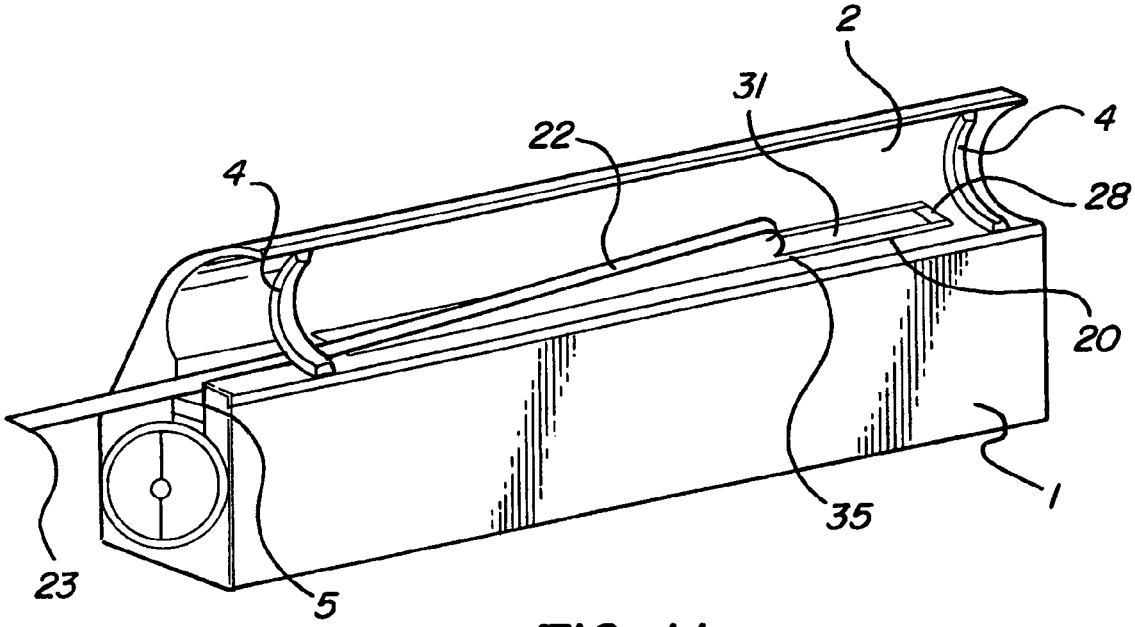
FIG-11
FIG-11a
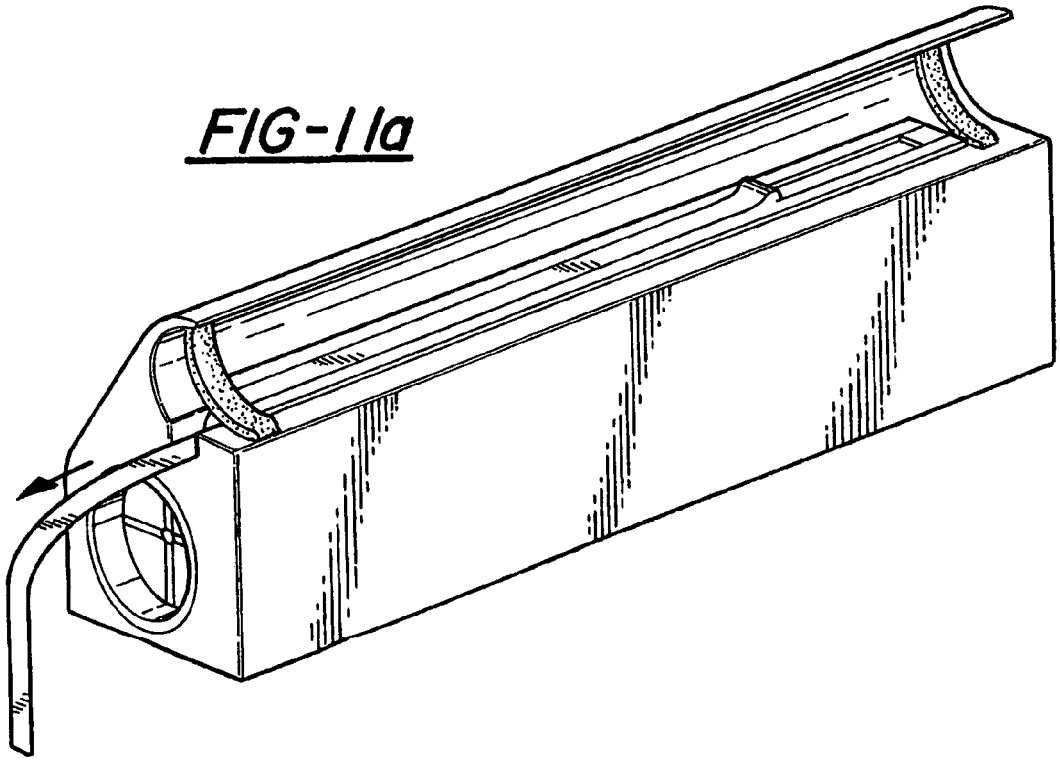

TEAR-STRIP SEAL AND TEAR-SEAL ASSEMBLY USING A PRE-CUT TEAR INITIALIZATION AND A TONER HOPPER, TONER CARTRIDGE AND IMAGE FORMING APPARATUS USING SAME AND METHOD OF MANUFACTURING SAME SEAL, TONER HOPPER AND TONER CARTRIDGE ASSEMBLY

BACKGROUND OF THE INVENTION

This patent application is a continuation of patent Ser. No. 08/370,968 filed on Jan. 10, 1995 now U.S. Pat. No. 6,552,780.

This invention relates to an apparatus for allowing the refilling and sealing of a toner hopper used in toner cartridge assemblies for dry toner imaging machines such as printers, copiers and facsimile machines.

The use of "throw-away" type toner cartridge assemblies is common in the dry toner imaging industry. The user of the printer, copier or facsimile machine must buy a new toner cartridge assembly from the manufacturer when the original assembly is depleted of toner. Toner cartridge assemblies are expensive and their disposal is a waste of good components. This expense and waste has created a need for remanufacturing and sealing used toner cartridge assemblies for shipment to the user.

The manufacturers seal the toner hopper assemblies of the new toner cartridge assemblies at their manufacturing location, and there is no leakage of the toner during shipment. For example, the manufacturers seal closed the top of the toner reservoir section of the toner hopper with a plastic sheet, then fill the toner hopper, located in the cartridge assembly, with dry toner. The plastic sheet is attached to both sides and ends of the hopper prior to assembling the toner hopper and fusing/plastic welding/ultrasonic welding the toner hopper together from its sub-components. Of course, this is done before assembling the toner hopper with the other sub-components of the cartridge. The original manufacturer has a slight advantage because they can seal the toner hopper before it is permanently assembled and fused/plastic welded. Aftermarket manufacturers, commonly known as rechargers or cartridge remanufacturers do not always have this luxury of working with the toner hopper prior to its permanent assembly. This would require splitting the hopper which is very expensive and requires greater expertise, equipment and labor. Many such rechargers are small "mom and pop" companies and cannot afford the extra expense. Consequently, applicants had to develop a product that would be practical for an already fused/plastic welded toner hopper, however, this development may also be used for a split hopper. After the toner hopper is sealed, assembled, joined, and filled with toner, it is assembled as a sub-component of a modular toner cartridge. This toner cartridge may be shipped to the end-user's location without spillage of the dry toner because the plastic sheet seals it. When the toner cartridge assembly is received at the end-user's location, the plastic sheet is removed from the toner reservoir in the hopper and the toner is exposed to the feed roller device for use in the imaging process of the printer, copier or facsimile machine. The plastic sheet and other original manufacturer sealing devices are not reusable and, furthermore, are not meant to be re-sealable as they are designed to be throwaway items.

Toner cartridge assembly remanufacturers have come up with various ways of sealing the toner hopper for shipment after refilling used cartridges. Applicant's U.S. Pat. No. 5,296,902 discloses a seal-insert applied over the passage from the toner hopper. The seal-insert has a slot covered with a removable adhesive tape/heat-tape that is peeled off or torn by the customer when the refilled toner cartridge is ready for use. The same patent also discloses a seal-insert with a slot that is covered or uncovered by a seal which slides over the seal-insert. Applicant's U.S. Pat. No. 5,282,003, now Pat. No. Re 35,529, discloses a seal-insert which includes slotted outer pieces sandwiching a slotted middle piece of resilient two-sided foam tape. A seal slides into or out of the seal-insert to close or open the slots. Applicant also has other U.S. Pat. Nos. 5,184,182 and 5,337,126, and application Ser. No. 07/850,930 filed on Mar. 13, 1992, currently abandoned and Ser. No. 08/019,300 filed on Feb. 18, 1993, also abandoned, disclosing similar seals and seal-inserts. U.S. Pat. No. 5,335,831 to Foster discloses a layered, compliant strip for sealing the toner hopper opening.

One problem that arises with the use of these seals and seal-inserts used in a toner hopper (of the style that has a narrow opening for the seal to pull through) is toner blockage in the passage between the reservoir and feed roller compartment, caused by the narrowness of the slot or slots in the seal-insert. But the slot has to be narrower than the sliding seal (in order that the seal completely closes the slot), and the sliding seal has to be narrow enough to slide through the opening in the side of the toner hopper. Applicant has application Ser. No. 08/333,055, filed on Nov. 1, 1994, now abandoned, which uses a seal-insert with a wider slot to prevent toner blockage while printing but still allow the seal and seal-insert to operate properly and prevent toner leakage during shipment of the refilled and remanufactured toner cartridge assembly. The seal must be able to slide through a very narrow opening on the side of the toner hopper, yet seal over a passage from the toner hopper wider than the narrow opening. Although the seal and seal-insert of application Ser. No. 08/333,055 solve the toner blockage problem by disclosing a seal made from a material that flexes as it is pulled through the narrow opening and allows a wider slot in the seal-insert, the seal and seal-insert are more difficult to manufacture and install and have an increased cost. Some toner cartridge remanufacturers may not want to use it for these reasons.

Through more careful study, applicant has found the cause of toner blockage associated with the use of the seals and seal-inserts in the patents and patents pending. The seal-insert is a slotted strip of rigid plastic affixed to the perimeter of the passage in the toner hopper. The slot is closed by a seal strip during the original cartridge manufacturing process. This prevents toner leakage until the seal strip is removed by the end-user, allowing toner to pass through the seal-insert as the toner cartridge assembly operates within the imaging machine.

Toner is generally composed of magnetic oxides of iron with a small amount of carbon black for die, all encapsulated or mixed in styrene. The styrene is the major component, making up over fifty percent of the toner in many formulations used in the market. Styrene is a great static electricity generator when put into motion. For example, if one rubs a low density, lightweight block of STYROFOAM (which is polystyrene, made from styrene with many similar properties) on a wool material, the STYROFOAM would stick to a wall or ceiling in the same way that an inflated balloon would, overcoming the force of gravity. When the toner cartridge operates, the toner that passes through the hopper passage and seal-insert slot generates electrostatic electricity. The styrene in toner becomes charged, and therefore, may stick to the plastic seal-insert as toner moves through the slot. Toner is also charged from the bias voltage of the developer roller component of the cartridge. Some of the toner that lands on the developer roller might bounce off the roller onto the plastic seal-insert where it adheres and collects with the toner charged through the rubbing motion.

To further aggravate the situation, the magnetic oxides of iron within the toner stuck to the seal-insert attract still more toner to the seal-insert slot area, causing a "snowball effect" as the toner accumulates. Eventually, the toner begins to block the slot in the seal-insert, causing a condition commonly known as "toner starvation". When toner starvation takes place, a portion of the developer roller is starved of toner and thus, no toner is transported from the developer roller to the photoreceptor drum over a given region. The net result is that over this region, a white streak of no-toner and therefore, no print occurs on the output page of the imaging machine. This toner starvation problem has plagued toner cartridge remanufacturers of such cartridges as the LX variety. Through careful observation, applicant has identified the problem or source of the problem, and has come up with a solution different than, and more effective than, simply making the slot wider. Furthermore, applicant has also developed a simple way to also solve the problem by making the slot wider. Both embodiments may be also used simultaneously, however. By using both embodiments simultaneously, toner starvation should never occur.

Tear-seals are used by themselves or with seal-inserts to seal the passage from the toner hopper to the feed roller compartment usually prior to refilling the toner hopper with toner. Tear-seals are torn off by the end-user before the remanufactured toner cartridge is inserted in the imaging machine for operation. The problem is that prior art tear-seals sometimes do not rip in a straight, even line, in some cases partially blocking the toner passage. These tear-seals are also hard to install over the toner passage thus, causing the problem they are supposed to prevent. In some cartridges, such as those of the LX variety, unremovable remains of the original equipment manufacturer (OEM) seal are present on the toner hopper, affecting the quality of any new seal used. While conventional tear-seals have previously been used with flexible seal-inserts, a device is needed which ensures a straight, even-width rip in the tear-sheet of the tear-seal that matches the slot in the seal-insert. Many of the tear-seals have had problems such as uneven tear, premature tearing off of rip portion, constriction of toner opening, difficulty in installing, and other problems.

SUMMARY OF THE INVENTION

Accordingly, it is an object of this invention to provide a shipping seal that will prevent toner blockage inside a toner hopper, between the reservoir and feed roller compartment of a toner hopper assembly, which is a component of a toner cartridge, which is used in imaging machines. In general, one way to prevent toner blockage is to use a conductive/antistatic material in the seals and then the seal-insert opening does not have to be widened. Alternatively, a new seal/seal-insert system is introduced that can allow a wider opening.

It is a further object of this invention to provide a seal and seal-insert for the passage from the reservoir which, when the seal is removed from the seal-insert, allows uninterrupted flow of toner from the reservoir to maintain the quality of the image produced.

Another object of this invention is to design a slotted seal-insert which does not attract toner to its surfaces and cause toner build-up and clogging of the slot. Thus, toner starvation may be prevented.

A still further object of this invention is to provide a tear-guide for the tear-sheet of a tear-seal on a seal-insert which enables the tear-sheet to be torn in a straight line with an even-width rip, opening up a wider opening in the seal-insert or the passage from the reservoir to the feed roller compartment. The tear-guide is used with a seal-insert and tear-seal. Also, with this tear-guide enhanced tear-seal, when the tear is controlled, the opening for toner flow is controlled, and thus when the tear is controlled, a wider than otherwise opening may be made because this torn strip in some cartridges such as LX must be then pulled through a very narrow constriction. By pulling a consistent strip, both the opening may be made wide enough and the even remains of the torn strip may be consistently pulled through the narrow constriction without problems. One such problem in prior technology is premature ripping of the entire tear portion causing a toner blockage.

A still further object of this invention is to provide an install tail for easy installation, whereby the seal may be easily installed. When the recharger pulls simultaneously on the install tail and the pull strip at the same time, the entire seal may be kept taut, and thus installation is greatly enhanced. With previous technology, many seals get ruined while installing, because there is no means for pulling the seal taut. With the development of the install tail, a very important part of this development, installation is significantly easier, less wastage is made, installation is quicker, and an OEM style seal may be installed in an already joined (non-split) toner hopper which is more difficult to do than when the OEM did it prior to joining. In fact, with this install tail, all the previous tear-seal and other art may be done in a more practical manner as well as the other new art of this invention.

In carrying out this invention in the illustrative embodiment thereof, a seal-insert is comprised of two rectangular, slotted outer pieces attached together by an inner-layer of two-sided tape. The two-sided tape is configured in a long u-shape such that it has an open end through which a seal is inserted or removed from between the outer pieces to block or open the slot. The seal-insert is attached over the passage from the toner hopper to the feed roller compartment of the toner cartridge assembly. The outer pieces are designed to be antistatic and/or conductive. The outer pieces may be made from antistatic and/or conductive materials or may be more conventional material covered with antistatic and/or conductive sprays, laminates, creams, waxes, coatings or films. Since the seal-insert is grounded through its attachment to the electrically grounded toner hopper, charged toner particles do not stick to the seal-insert and clogging of the slot in the seal-insert and passage from the toner hopper is eliminated. This insures a steady flow of toner to the feed roller compartment and prevents white streaks on the output paper of the imaging machine caused by toner starvation.

In another embodiment, a conventional tear-seal used with a seal-insert is improved by securing a tear-guide to the tear-sheet of the tear-seal. The tear-guide has a narrower width than the tear-sheet, approximately equal to the width of the slot in the seal-insert. The tear-guide material is chosen for good adhesion to the tear-sheet and good longitudinal strength so it will not break when pulled by the end-user. It may be an adhesive tape. If using an adhesive tape, part of the tear-guide must be kept free from adhesive so it will pull through the slot. This may be done either by not removing some of the tape backing material or by not applying adhesive along the full length of the film tape material. An end of the tear-guide is fed through the opening in the side of the toner hopper, and when pulled will tear the tear-sheet in a straight line and provide an even width rip or opening that will not block toner flow through the toner passage and seal-insert slot. The tear-sheet is also optionally made from or coated or laminated with antistatic and/or conductive material to prevent toner attraction. It may optionally include a stiffener, internal or external, to enable the tear-seal to be easily and efficiently attached to the toner hopper.

BRIEF DESCRIPTION OF THE DRAWINGS

This invention, together with other objects, features, aspects, and advantages thereof, will be more clearly understood from the following description, considered in conjunction with the accompanying drawings.

FIG. 10*a* shows the tear-seal, tear-guide and insert after assembly.

FIG. 10*b* demonstrates how the tear-seal is gripped when adhering it to the toner hopper.

FIG. 11 illustrates how the tear-seal and seal-insert are used together on the toner hopper.

FIG. 11*a* shows a toner hopper assembly with a seal in the process of being torn.

COMPLETE DESCRIPTION OF THE PREFERRED EMBODIMENT

Figure 1:
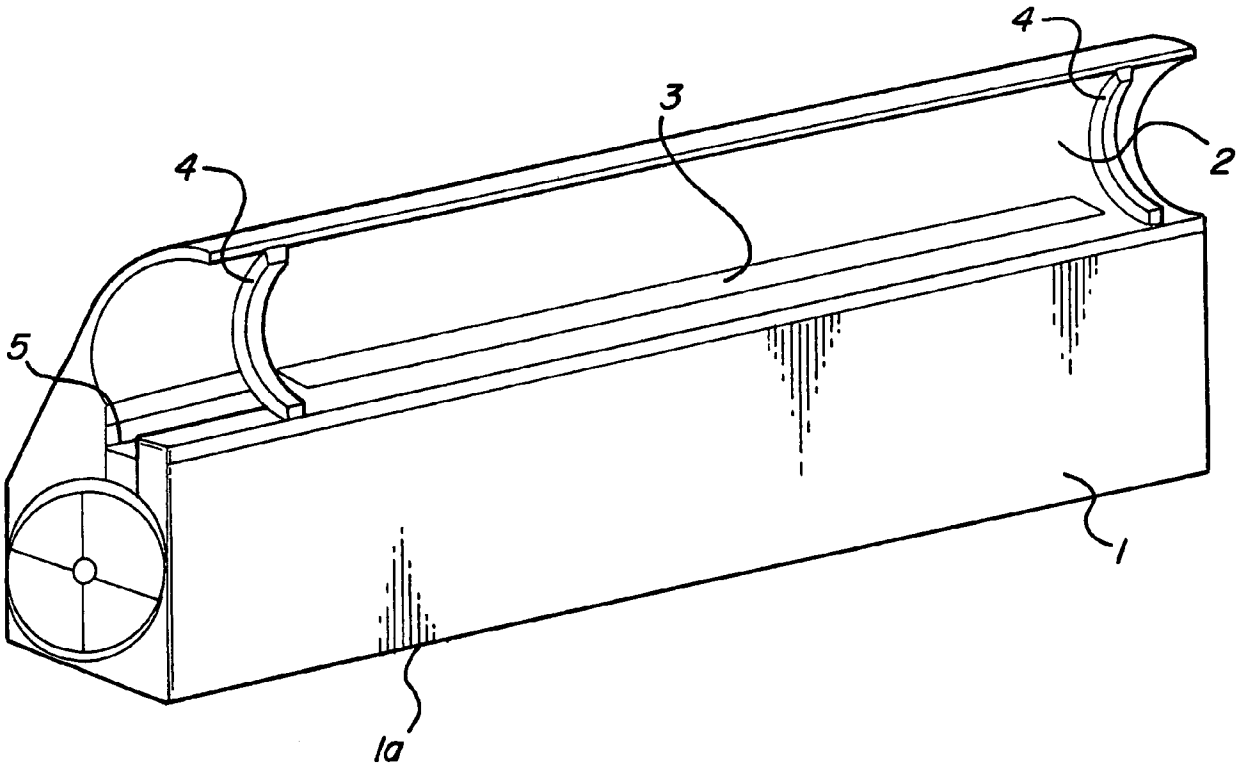
FIG-1 (PRIOR ART)
FIG. 1 is an isometric view of a prior art toner hopper, which is part of a toner cartridge assembly.

This section will begin with a definition of some terms used in this patent application. The purpose of this section is to try to avoid ambiguity in the meaning of any of the terms defined.

Nomenclature

1. Image Forming Apparatus or Image Forming System or Imaging System: An image forming apparatus is any device that uses dry toner to make an image, including but not limited to a laser printer, copy machine, facsimile machine and microfiche machine. An image forming apparatus uses a dry toner to make the image.
2. Toner cartridge: A toner cartridge is a device that goes into an image forming apparatus and has a photoreceptor, toner hopper and a waste toner hopper. There may be some toner cartridges where the toner hopper and waste toner hopper are connected or have interchanged components. Some toner cartridges use holding pins to attach the toner hopper to the waste toner hopper. Some older cartridges use a case to house the toner hopper and waste toner hopper and thereby hold them in proper position. Some toner cartridges do not include all the above components, for example, may be missing a photoreceptor and/or the waste toner hopper. This may be particularly so with a color toner cartridge.
3. Toner Hopper: A toner hopper contains a toner storage container, a developer roller, a printer contact device, a developer roller contact device, a shipping seal and various seals, strips and/or blades to prevent leaks. It usually contains a "magroller sealing blade" and a spreader blade or doctor blade. Oftentimes, a toner hopper contains a stirring paddle for mixing the toner. Sometimes a toner hopper has a "toner low bar" for sensing a low toner condition. Also, sometimes a toner hopper has an indicator for whether the shipping seal has been pulled or not. A toner hopper also has end-seals that seal the developer roller near the ends from leaking out. A toner hopper also has a scraper to scrape near the ends adjacent the end-seals either to prevent toner from leaking upstream or downstream to the end-seals. Some toner hoppers do not include all the above components, for example, maybe missing a shipping seal or other component.
4. Waste toner hopper or Photoreceptor Housing: A waste toner hopper is a device that collects unused toner. Often the waste toner that it collects may be mixed with paper particles. Usually a waste toner hopper has other components besides a receptacle for receiving the waste toner. It usually contains a drum cleaning blade otherwise known as a wiper blade. It usually contains a recovery blade, sometimes known as a scavenger blade, keeper blade, MYLAR or waste hopper blade.
5. Photoreceptor: A photoreceptor reacts to light. In the typical case, a photoreceptor will be insulative but conductive when exposed to laser light. A photoreceptor may be manufactured in the form of a drum or a belt. A drum photoreceptor is a cylinder with a photoconductive coating on it. A belt photoreceptor is a belt with photoconductive coating on it used in an image forming apparatus. A photoreceptor in some ways resembles a capacitor. In an imaging system, the photoreceptor's latent image defines the image on the page.

6. Reservoir, or Toner storage container or Toner Storage Tank: A toner storage container is also called a reservoir. It is essentially the tank that stores the toner for use. Oftentimes, the reservoir has one or more paddles to stir the toner.
7. Developer roller: A developer roller is a roller that holds toner for dispensing in the print process.
11. Contact: (Noun) Contact is defined as electrical contact between any two or more things. It can also be a device that makes electrical contact between any two or more things directly or indirectly. A contact device does not have to be the only supply of electricity to another component, for example, a developer roller may have a primary contact device and a secondary contact device that may have a relatively minor electrical effect on the developer roller and is also considered a contact device. If a contact uses a spring directly in its electrical path, then contact means the spring and the contact, if the spring is not mentioned with it.

Contact: (Verb) to make electrical contact between two or more things either directly or indirectly.

14. Shipping seal: A seal device that prevents toner from leaking from the toner hopper of a toner cartridge from the time the toner cartridge is manufactured or remanufactured until the time when the toner cartridge is to be used by the end-user. The enduser then pulls on the shipping seal after which toner is released to be dispensed in the toner cartridge so that the toner cartridge may be installed into the image forming system.
20: Paddle: A paddle or agitator is a device on a rotating rod inside the toner hopper that agitates to toner to stay stirred for improved toner properties which enhances print quality or helps prevent print quality from degenerating.
22: End seal or end-seal or end-felt: A seal near the ends of the print region of a developer roller which are there to prevent or minimize leakage of toner beyond the end-seals. End-seals may be hard magnetic seals or soft felt-like material.
26. Toner: A dry powder used to print on an output page. Oftentimes, toner powder contains mostly styrene with oxides of iron, but this is not a rule, as long as the powder is designed to wind up on the output page.

Referring to FIG. 1, some components of a prior art toner cartridge assembly are shown. The typical toner cartridge assembly includes a toner hopper 1*a* and a waste toner hopper (not shown). The usual waste toner hopper includes a photoreceptor, a cleaning blade a charging device for electrostatically charging the photoreceptor and a container to receive waste toner. A toner hopper 1*a* is a subassembly of a complete toner cartridge assembly sold to end-users. The reference numeral 1 generally refers to the reservoir where dry toner is stored which is a subassembly of a toner hopper 1*a*. There is a compartment 2 for a feed roller (not shown). A long, narrow passage 3 is shown between the feed roller compartment 2 and the reservoir section 1 of a toner hopper 1*a*. The feed roller dispenses the dry toner after it receives the toner from the reservoir 1 through the passage 3 into the feed roller compartment 2. The toner is fed to the image forming components of the toner cartridge assembly. Felt-like sealant material 4 is used to prevent toner leakage from the ends of the feed roller.

Figure 2:
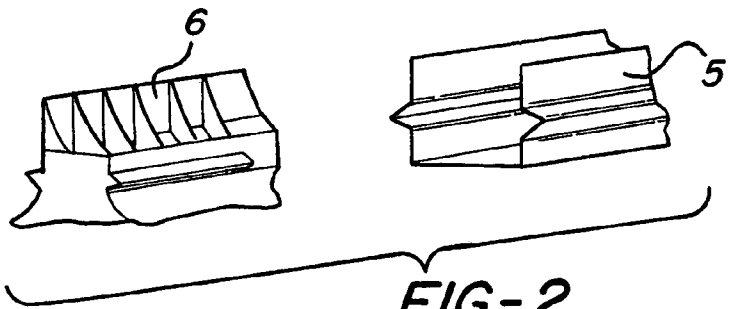
FIG-2 (PRIOR ART)
FIG. 2 is an enlarged illustration of how a plug closes the opening in the side of the cartridge assembly.

An opening 5 in the side of the toner hopper 1*a* enables a seal for the passage 3 to be pulled, and thereby, removed through the side of the hopper 1*a*. A plug 6, shown enlarged for clarity in FIG. 2, fits into the opening 5 to prevent toner leakage from the opening 5 during operation of the toner cartridge assembly. A seal prevents toner leakage from the passage 3 and the opening 5 during shipment of the new toner cartridge assembly.

It should be apparent from the drawings that without a seal for the passage 3, if the dry toner hopper 1*a* was rotated from the upright position shown, the toner would spill from the reservoir 1 through the passage 3 into the feed roller compartment 2 and out into the remainder of the cartridge assembly. This would cause a great mess, would waste toner, and would reduce the quality of the image produced when the toner cartridge assembly is put into operation within the printer, copier or facsimile machine.

Figure 3:
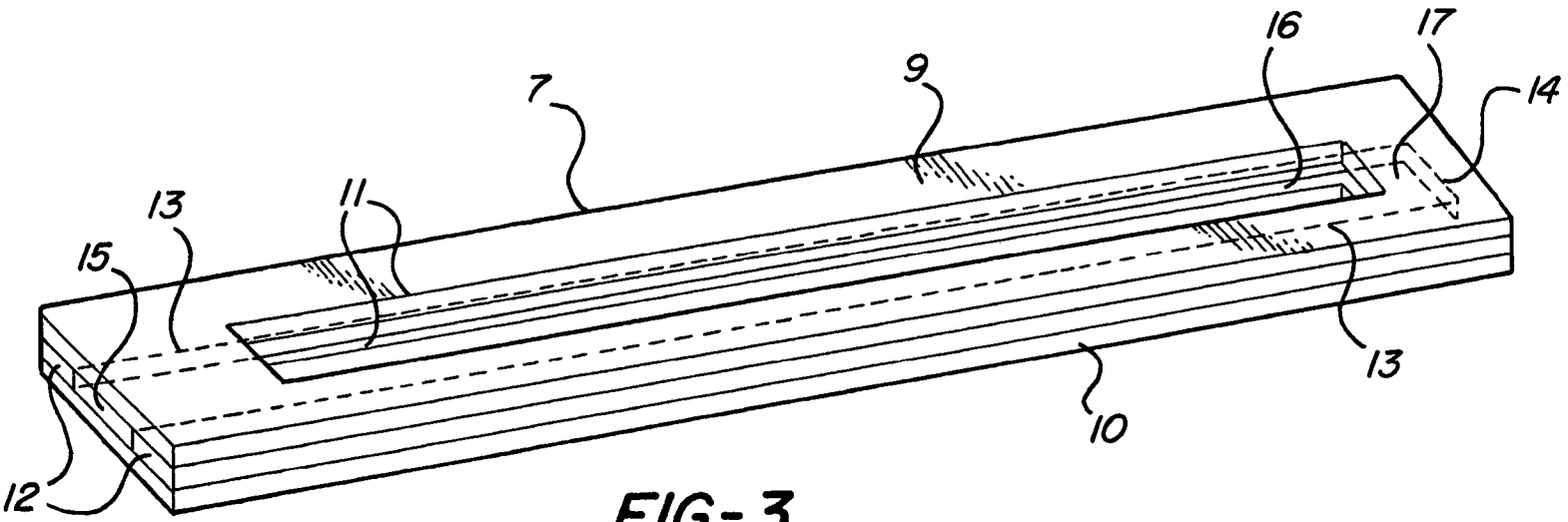
FIG. 3 shows the seal-insert of this invention, enlarged for clarity.
Figure 4:
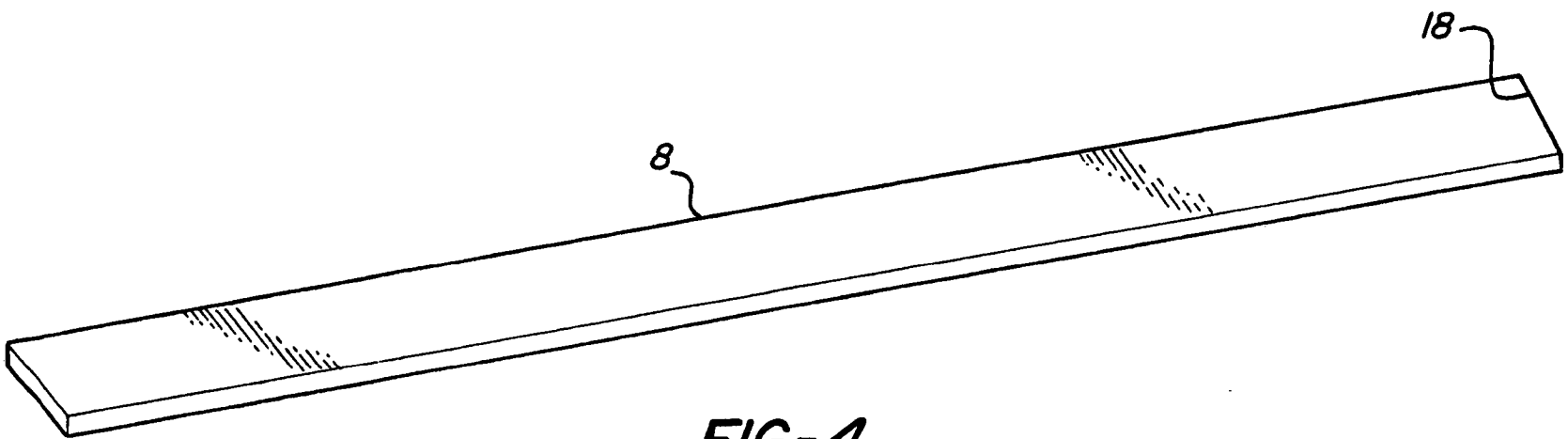
FIG. 4 shows the seal for closing the slot in the seal-insert.

FIGS. 3 and 4 show the seal-insert 7 and seal 8, respectively, of this invention. The seal-insert 7 includes two rectangular outer pieces 9 and 10 having identical slots 11 extending along their lengths. The outer pieces 9 and 10 are attached together by an inner layer of two-sided tape 12 such that the slots 11 align. The two-sided tape 12 is configured in a long u-shape having legs 13 connected by a cross-piece 14 at one end of the seal-insert 7. The open end 15 of the two sided tape 12 configuration is for first receiving the seal 8. The two-sided tape 12 may be of one piece construction as illustrated or may be several connected pieces. The legs 13 of the tape 12 are narrower than the widths of the outer pieces 9 and 10 on each side of the slot 11, providing overhangs or channels 16 for the seal 8 on each side of the slots 11 between the outer pieces 9 and 10. The cross-piece 14 of the two-sided tape 12 is also narrow enough to provide a pocket 17 for receiving the insertion end 18 of the seal 8. The two-sided tape 12 may be a foam-type two-sided tape to allow more resilient adjustment of the distance separating the outer pieces 9 and 10, but in general it should be just a thin two-sided tape not too much thicker than the seal 8. The two-sided tape or adhesive 12 may also be replaced with plastic laminated with tape or adhesive on each side.

The drawings are not to scale. The outer pieces 9 and 10 are usually about eight and one quarter inches long and about nine-sixteenths of an inch wide when used for the LX cartridge. The slots 11 are about one-eighth to one quarter inch wide and seven and three-quarter inches long for the LX cartridge. The legs 13 of the two-sided tape 12 are about three-sixteenths of an inch wide and the cross-piece 14 is approximately one-sixteenth of an inch wide. The legs 13 and cross-piece 14 may be applied flush with the perimeter edges of the outer pieces 9 and 10, making the channels 16 about one-sixteenth of an inch wide and the pocket 17 about three sixteenths of an inch long. But all measurements could change depending on the type of toner cartridge assembly and the size of the passage 3. For example in the BX cartridge and the FUJI-XEROX long cartridge, the dimensions of each parameter may be much larger since it handles a much larger paper size, larger in both length and width.

The seal 8 comprises a length of thin flexible material such as plastic, polycarbonate, PETG or polyester. It is at least nine inches in length for the LX toner hopper 1*a* so it will extend a fair amount from the opening 5 in the side of the reservoir 1 and may be easily gripped and manipulated. The seal 8 for the LX toner hopper 1*a* is three sixteenths to a quarter inch wide for easy sliding into or out of the seal-insert.

7.

Figure 5:
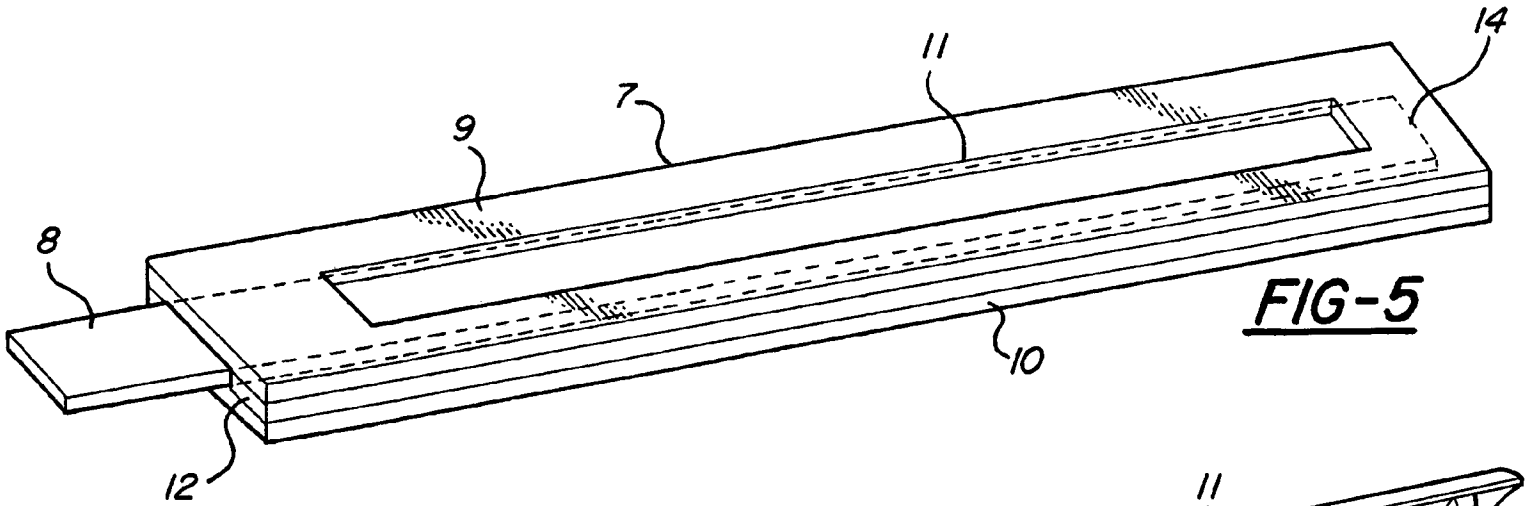
FIG. 5 illustrates how the seal fits into the seal-insert.

FIG. 5 illustrates how the seal 8 fits into the seal-insert 7. The seal 8 slides into the channels 16 between the outer pieces 9 and 10. The insertion end 18 of the seal 8 enters the pocket 17 of the seal-insert 7, closing or blocking the slots 11.

Figure 6:
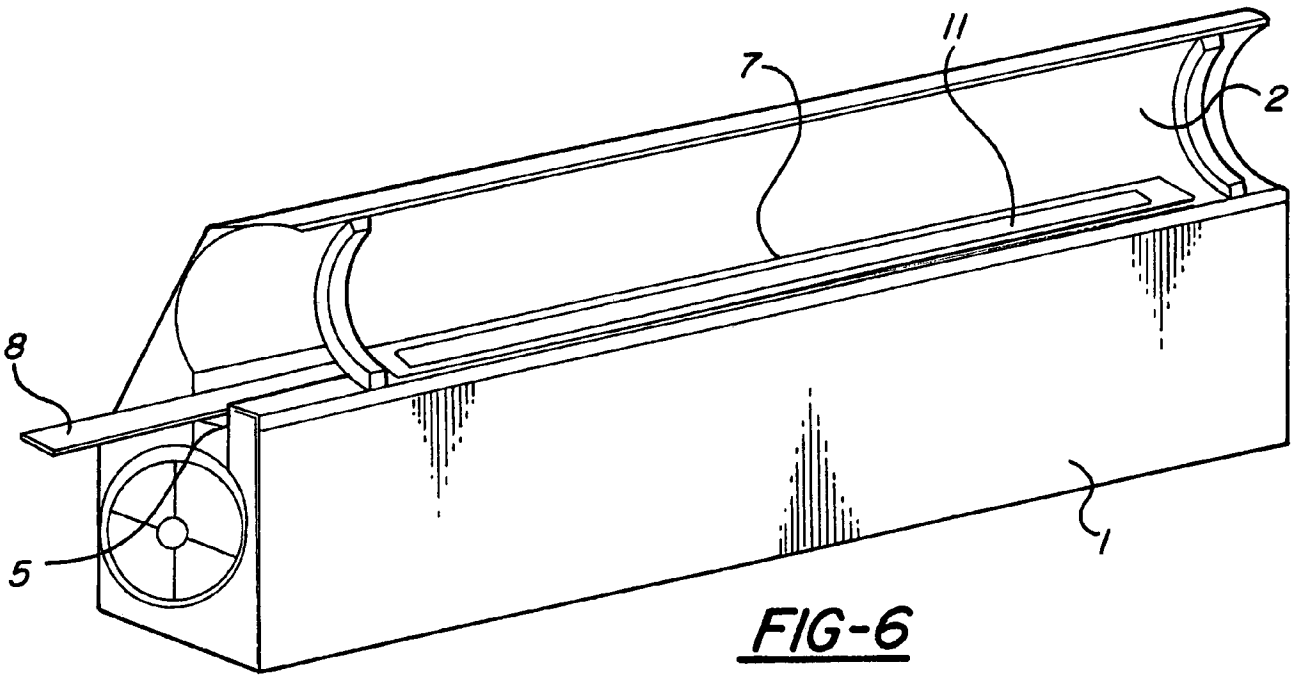
FIG. 6 illustrates how the seal and seal-insert attach to the toner hopper.

As shown in FIG. 6, the seal-insert 7 is applied over the passage 3 from the reservoir 1. The outer piece 9 or 10 of the seal-insert 7 facing the passage 3 is adhered with the adhesive or tape to the perimeter of the passage 3 such that the slots 11 face without obstruction, the interior of the reservoir 1.

Before the reservoir 1 is refilled with toner, the seal 8 is fed through the opening 5 in the side of the reservoir 1 into the seal-insert 7. The cartridge is then assembled and shipped to the end-user. The seal system does not leak. When the end-user receives the refilled and remanufactured toner cartridge assembly, the end-user pulls the seal 8 from the opening 5 in the side of the reservoir 1. The seal 8 slides out of the seal-insert 7 and opens the slots 11 in the outer pieces 9 and 10. The cartridge assembly is placed into the printer, copier or facsimile machine. When the assembly is in operation, toner moves from the reservoir 1 through the passage 3 and slots 11 in the outer pieces 9 and 10 of the seal-insert 7 to the feed roller compartment 2, and the feed roller then provides dry toner to the photoreceptor drum.

For the reasons discussed in detail in the Background, prior art seal-inserts can sometimes cause toner blockage between the reservoir 1 and feed roller compartment 2, resulting in poor quality images. To prevent this problem, the rectangular, slotted outer pieces 9 and/or 10 of the seal-insert 7 are made from conductive and/or antistatic material. For example, there are antistatic/conductive plastics available on the market, and there are also antistatic/conductive plastics impregnated with conductive materials such as conductive carbon black, graphite, metal bits, metal powder, and other conductive pigments. Additionally, plastics may be covered or coated with antistatic and/or conductive sprays, coatings, paints, treatments, or films. These covering layers may be applied over the surfaces of the outer pieces 9 and 10 after the seal-insert 7 is assembled.

A particularly effective and suitable material for outer pieces 9 and 10 of the seal-insert 7 is an aluminum laminate used in the construction industry for static electricity and fire prevention. This material is from 0.010 to 0.050 inches thick and contains a layer of aluminum usually around 0.003 inches thick. A reduced cost version uses PVC plastic as the laminate, and other cheap plastics, as well as other conductive metals, may be used. The aluminum laminate has the advantage of being eighty percent less expensive than polycarbonate sheets or rolls. The aluminum also gives the seal-insert 7 greater stiffness and rigidity, making the seal-insert easier to apply over the passage 3 from the reservoir 1 and making the seal 8 easier to insert into and remove from the seal-insert 7.

The seal-insert may be electrically grounded through its attachment to the reservoir 1. By having the outer pieces 9 and 10 of the seal-insert 7 be conductive and/or antistatic, toner will not stick to the seal-insert 7. Toner will therefore not build up on the seal-insert 7 and block the slots 11 through the seal-insert 7 and the passage 3 from the reservoir 1. The toner starvation problem is eliminated and no white streaks appear on the output paper. Seal-inserts can continue to be made with narrow slots without fear of toner blockage. This is important because this type of seal-insert is easier to manufacture and install than seal-inserts with wider slots.

It should be noted that while a particular seal and seal-insert design has been disclosed, the antistatic and conductive features may be used with any of the seals and seal-inserts of the prior art patents and patents pending, including applicant's co-pending application Ser. No. 08/333,055, filed Nov. 1, 1994. Regardless of the seal-insert design, the antistatic and/or conductive material prevents toner from clogging the slot.

Figure 7:
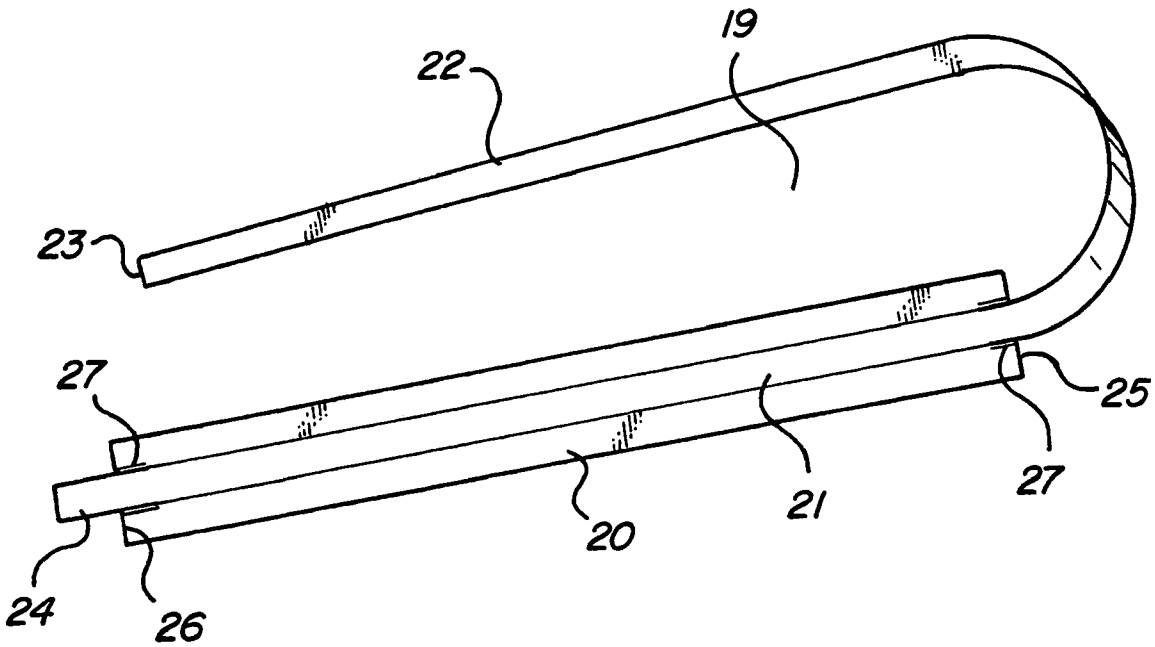
FIG. 7 shows a second embodiment of the seal comprising a tear-sheet and tear-guide.

FIG. 7 shows another type of after-market seal designed to prevent blockage of toner flow between the reservoir 1 and feed roller compartment 2. A tear-seal 19 and a simpler seal-insert are used in place of the sliding seal 8 and seal-insert 7. The tear-seal 19 comprises a tear-sheet 20 and a tear-guide 21. The problem with the prior art tear-sheets is that they often do not tear in a straight line, regardless of the thickness or other variable properties of the material from which the tear-sheet is made. If the rip in the tear-sheet is not even and does not correspond to the slot in the seal-insert or to the passage 3 from the reservoir 1, interruption in toner flow along the length of the passage 3 can occur. This diminishes the quality of the image produced. The tear-guide 21 of this invention is used to rip a straight, even opening in the tear-sheet 20. If an inferior material is used for the tear-sheet 20, more material than needed will tear off, which is alright, as long as the minimal amount of torn material is the width of the tear-guide.

The tear-sheet 20 may be a ribbon of material made from MYLAR, acetate, cellophane, polyolefin, woven or unwoven material, paper, plastic, fabric or other such material. The tear-sheet 20 may itself be a laminate, and in this case both layers of the tear-sheet would tear. The tear-sheet 20 is sized to either provide coverage over the toner passage from the reservoir 1 or, if a seal-insert is used, over the slot in the seal-insert. It has been found through experimentation that by using a composite formed from one layer of any of the above mentioned tear-sheet materials and a second layer (tear-guide 21) of, for example, a heat-seal type material, the tear-sheet layer may be torn in a controlled manner when the second layer is pulled.

The tear-sheet 20 and tear-guide 21 form a layered seal. The tear-guide 21 material is laminated to the tear-sheet 20. This can be done by using tape, chemical adhesive, infrared-cured adhesive, pressure fusing, heat-pressure fusing, or other adhesives or methods. The tear-guide 21 material is chosen or designed such that it does not tear or rip. The desired properties are tear resistance, strength, good adhesion to the tear-sheet 20, longitudinal strength and pull strength. The tear-guide 21 material may itself be a laminate of any number of layers. It may be comprised of strands of material with a good longitudinal strength. The tear guide 21 could be a woven, unwoven, plastic or urethane material. It may be a heat-tape, as previously mentioned, or an adhesive tape. It may even be one of the heat-tape materials to give it the OEM look and have adhesive on it for easy manufacturing. Of the different heat-tape materials, there are very many available, too numerous to mention, each version by a different manufacturer, and so these materials, in general, will be referred to as heat-tape. Most of them, however, are multilayer, usually two layers, usually copolymers. Generally, heat-tapes consist of a layer of strength and a heat-adhesive layer or heat-activated adhesive layer. The layer of strength can be most any plastic but polyester or polyethylene are popular strength layers in the heat adhesive industry. The heat-activated adhesive layers may vary immensely in the heat-tape-adhesive market.

The tear-guide 21 is narrower than the tear-sheet 20 so it will control the width to be torn from the tear-sheet 20. The tear-guide 21 is well over twice as long as the tear-sheet 20. The tear-guide 21 has a long free length portion 22 with a pull end 23. The tear-guide 21 also has a short grip portion 24. The long free length portion 22 of the tear guide 21 extends from a first end 25 of the tear-sheet 20. The short grip portion 24 of the tear-guide 21 extends from a second end 26 of the tear-sheet 20. Each end 25 and 26 of the tear-sheet 20 optionally has two short cuts 27 through it adjacent each side of the attached tear-guide 21. The cuts 27 in the first end 25 of the tear-sheet 20 provide a starting point for the tear and ensure an opening through the tear-sheet 20 of the right width, approximately the same width as the tear-guide 21. The cuts 27 in the second end 26 of the tear-sheet 20 ensure that the tear-guide 21 and the torn area of the tear-sheet 20 separate cleanly from the tear-sheet 20 and the width of the torn opening remains constant and that the short grip portion will cleanly pull through. As a result, the tear-sheet 20 tears in a straight, even line, providing an uninterrupted opening of constant width and thereby allowing evenly distributed toner flow, emulating, improving on and replacing the OEM seals.

As discussed, the tear-guide 21 could be a heat tape or simple adhesive tape. Further specific examples of materials used as the tear-guide 21 would be polypropylene of a polypropylene co-laminate. When polypropylene is co-laminated with polyethylene or other materials to form a tear-guide 21, the tear-guide will have excellent strength and will not break or tear apart when pulled. Polypropylene was tested in a co-laminate with polyethylene. The tear-guide 21 consisted of a layer of polypropylene three-thousandths of an inch thick and a layer of polyethylene two-thousandths of an inch thick. Of course the thicknesses could be reversed or could be equal, and could be increased or decreased. The polypropylene provides the heat adhesiveness to attach the tear-guide 21 to the tear-sheet 20 and the polyethylene provides the strength. The tear-guide 21 is laminated on the tear-sheet 20 using a heat roller, heat iron, flat iron, press iron, heat adhering the guide to the sheet. In essence, the tear-guide 21 and tear-sheet 20 form a multiple laminate that tears in a straight line when the guide is pulled and provides an opening in the sheet having an even width. It should be noted that the tear-guide 21 is not limited to the materials noted above. Any plastic or co-laminate of any 2 or more plastics may be used. In general, the thickness will range from 0.001 inch to 0.010 inch, however, 0.02 inch to 0.05 inch is the most suitable range. The most important properties of the tear-guide are tear-strength, tear-resistance, pull strength, and flexibility. As stated, the tear-guide 21 may be attached by heating a beat tape, by using an adhesive tape with the protective backing removed only for the length of the tear-sheet 20, or by applying an adhesive on a plastic strip where the amount of adhesive applied is equal to the length of the tear-sheet 20. The tear-strip 21 or tear-guide 21 may be made of any plastic, single layer, laminate, or multiple laminate. For example, good materials to choose from are polyester, polyethylene, polypropylene, polycarbonate, vinyl, urethane, PETG, TYVEC, among many other plastics.

Figure 8:
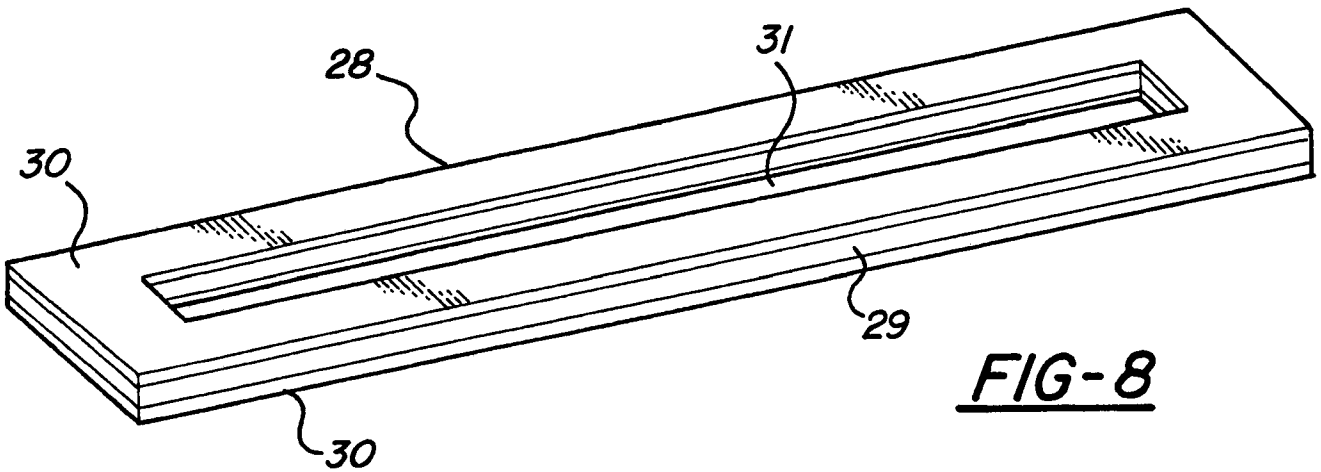
FIG. 8 shows a stiff version of a seal-insert for use with the tear-seal.
Figure 9:
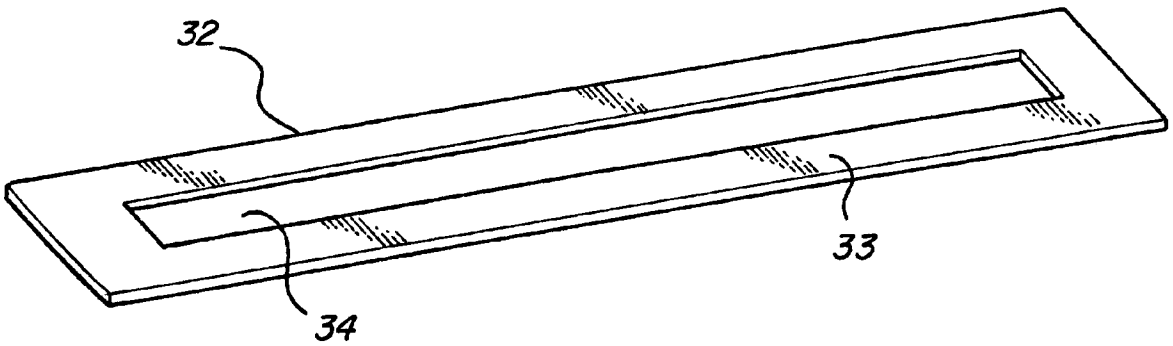
FIG. 9 shows a flexible version of a seal-insert for use with the tear-seal.

The tear-seal 19 attaches to a seal-insert for use in the toner cartridge assembly. FIGS. 8 and 9 show different types of seal-inserts which may be employed with the tear-seal 19. As with the other Drawings, the Figures are not to scale and the thicknesses have been enlarged for clarity. The seal-insert 28 shown in FIG. 8 is a stiff version comprising a slotted inner piece 29 of plastic, metal, cardboard, urethane, urethane rubber, rubber, plastic with metal layer, plastic with aluminum layer, antistatic material such as polypropylene or polyethylene with aluminum layer as used in construction industry, or similar stiff material. Two-sided tape 30 is adhered to each side of the inner piece 29. The stiff inner piece 29 and both lengths of two-sided tape 30 are provided with matching slots 31 which correspond in size to the passage 3 from the reservoir 1 to the feed roller compartment 2. A length of any stiff material may be sandwiched between two lengths of two-sided tape and then stamped on a press to the right size and to form the slots 31, so the cuts are symmetrical at each end of the seal-insert 28. In some cartridges, an offset slot would be preferred over the symmetrical slot 31. Conventional two-sided tape comes with a release liner, a covering or liner on one or both sides of the actual adhesive tape to prevent the two-sided tape from sticking to anything prior to removing the liner and applying the tape. The tear-seal 19, as will later be illustrated, is attached to the two-sided tape 30 surface which would face the feed roller compartment 2. The seal-insert 28 is then attached to the perimeter of the passage 3 of the reservoir 1 by removing the second liner on the two-sided tape 30 surface facing the reservoir 1, and then pressing the seal-insert 28 down on the perimeter.

FIG. 9 shows a flexible seal-insert 32. In this version, the seal-insert 32 is simply comprised only of two-sided adhesive tape 33 (or heat tape). The two sided tape 33 is stamped on a press such that it includes a slot 34 corresponding in size to the passage 3 from the reservoir 1 to the feed roller compartment 2. The liner is pulled off the two-sided tape 33 and the seal-insert 32 is adhered to the tear-seal 19 (with the tear-guide 21 in the open slot 34) on the one side of the seal-insert 32 and to the perimeter of the passage 3 on the other side. Other types of flexible material, including some kinds of fabric and rubber with adhesive applied on each side, or foam tape may be used for the flexible-version seal-insert 32.

Just as with the seal-insert 7, both seal-insert versions 28 and 32 may be made from antistatic and/or conductive material, or may be coated with antistatic and/or conductive material, to prevent toner from sticking to the seal-inserts and blocking toner flow from the passage 3 in the reservoir 1 through the seal-insert slot. But the tear-sheet 20 could also be made from antistatic and/or conductive material since it covers the seal-insert 28 or 32 on the side opposite that facing the reservoir 1. One way of doing this is to make the tear-sheet 20 from metallic material. Many of the previously described materials for the tear-sheet 20 may be found in metallic form, such as metallic MYLAR, or a standard metallic gift-wrap ribbon. For example, a metallic ribbon material is readily available in the gift-wrap industry. Another good example is the silver material that antistatic bags are made from, which could be used to form both the tear-sheet 20 and flexible seal-insert 32. Of course, the tear-sheet 20 could be laminated or coated with a conductive coating. Using a TYVEC-like material will allow the reservoir 1 to "breathe", if the reservoir 1 is inadvertently compressed, and prevent toner from being forced from the reservoir 1 through its seals. TYVEC itself has too much tear resistance, but applicant is testing different grades and thicknesses of TYVEC, as well as looking for materials which have similar properties, to find a good tear-sheet material that can also breathe.

Figure 10:
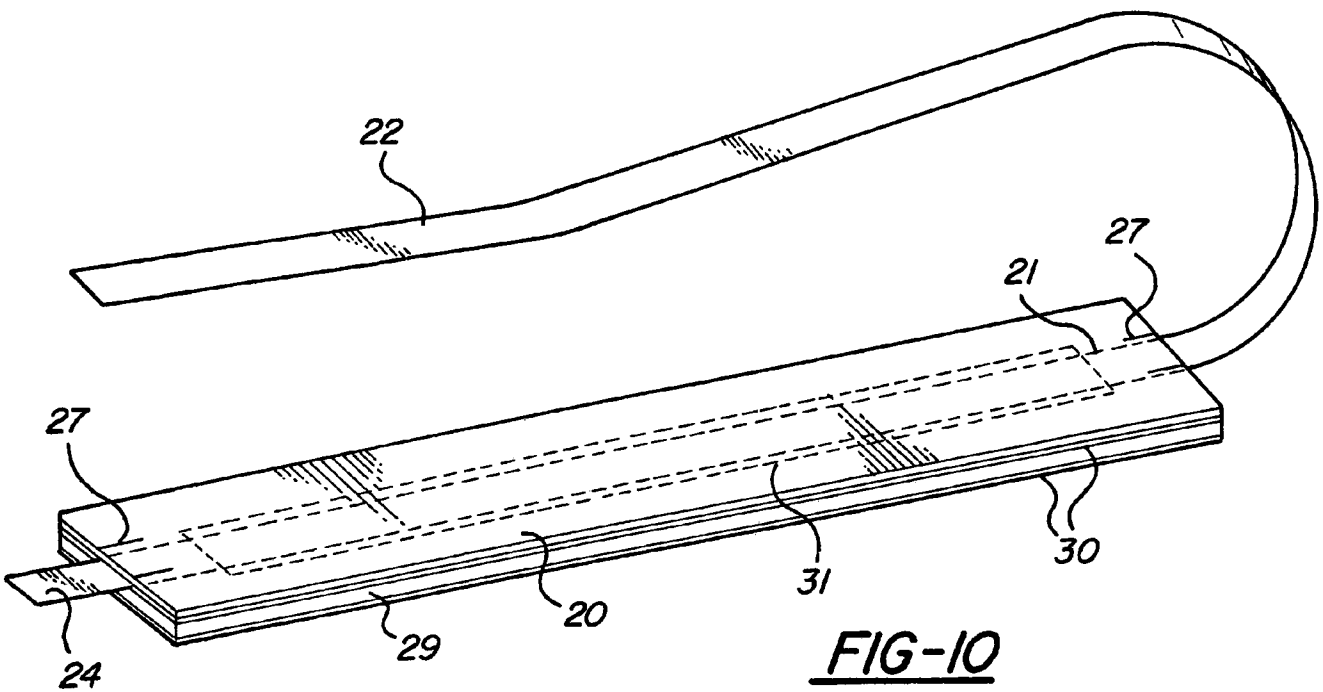
FIG. 10 shows the combined tear-sheet, tear-guide and seal-insert.

FIGS. 10 and 10*a* illustrate how the stiff seal-insert 28 and tear-seal 19 are used together. The tear-sheet 20 is adhered to the seal-insert 28. The tear-guide 21 is located between the tear-sheet 20 and the seal-insert 28. The tear-guide 21 is sized such that it has a slightly smaller width than the slot 31 in the seal-insert 28, so the tear-guide 21 does not stick or is not adhered to the seal-insert 28. A tear-seal 19 would be secured to a flexible seal-insert 32 in the same manner.

Figure 10C:
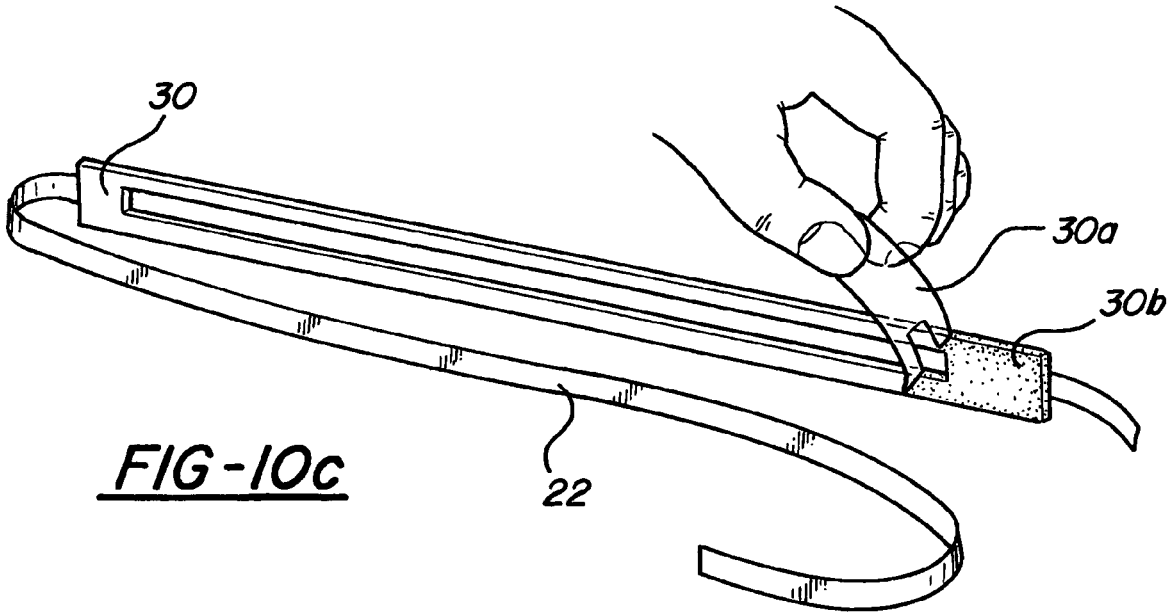
FIG. 10*c* shows the removal of the liner process of the seal system using the tear-seal, tear-guide and seal-insert.
Figure 10D:
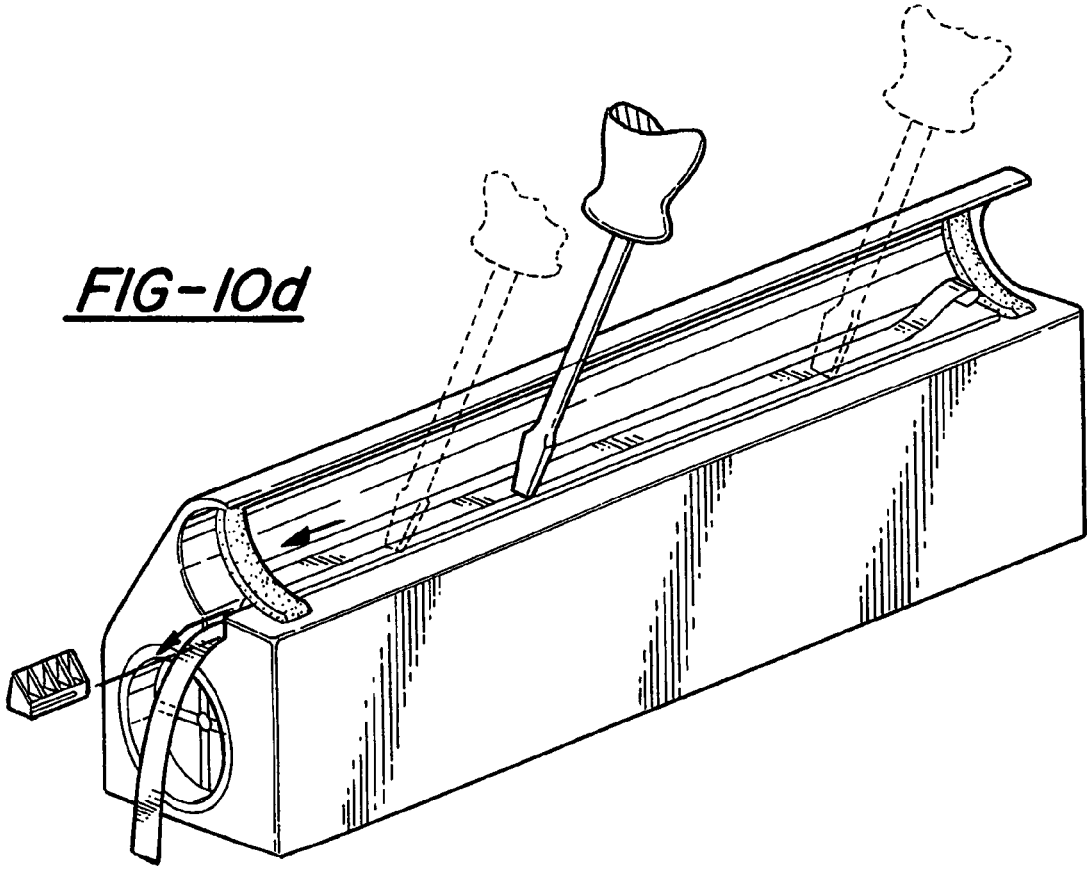
FIG. 10*d* shows how the seal system may be burnished after assembly.

FIGS. 10*b* and 10*c* show the install process. Installing the seal system, typically done before adding the toner powder, is very easy. First, the adhesive liner 30*a* or 33*a* is removed as shown in FIG. 10*c*. At this point, the adhesive 30*b* on the bottom of the seal-insert 28 or 32 is now exposed, since the seal system must be leakproof. The adhesive 30*b* may be of most types such as tape, glue, foam tape or normal adhesive. Once the liner 30*a* or 33*a* is totally removed, the installer would grasp the seal by the short grip portion 24 in one hand and the free length portion 22 as shown in FIG. 10*b* to keep the seal-insert 28 straight, taut, and stable.

The recharger technician would then carefully adhere the seal-insert 28 onto the perimeter of the passage 3 from the reservoir 1 such that the slot 31 and passage 3 align. This tail 24 acts as an easy-grip-handle, for easier installation than other seals and is a very important part of this invention. This method of installation using a tail may be used in the stiff version, the flexible version, or most other seal systems. The free length portion 22 of the tear-guide 21 would be doubled back over the length of the tear-sheet 20. The pull end 23 of the free length portion 22 would be fed under the felt-like sealant material 4 and through the opening 5 in the side of the reservoir 1.

FIGS. 11 and 11*a* demonstrate how the seal-insert 28 and tear-seal 19 are used together to form a removable seal for the reservoir 1. The tear-sheet 20 is on the side of the seal-insert 28 which faces away from the reservoir 1 and passage 3. It should be noted here that when using adhesive tape as the tear-guide 21, the liner or tape cover would not be removed from the short grip portion 24 and the long free length portion 22 so the tape does not stick to the reservoir 1, feed roller compartment 2 and opening 5. The plug 6 is inserted into the opening 5 over the pull end 23 of the tear-guide 21, and the toner cartridge is reassembled, filled with dry toner, and shipped to the end-user without fear of toner leakage. Optionally, the short grip portion 24 may be cut off once installed, however, if it remains, it will usually have no adverse effect, so therefore, cutting the short grip portion 24 is not essential.

To use the toner cartridge assembly, the end-user would grasp and pull the pull end 23 of the free length portion 22 of the tear-guide 21 extending from the opening 5. The tear-guide 21 will tear the tear-sheet 20 in a straight line, creating an even rip 35 having a width approximately equal to the width of the slot 31 in the seal-insert 28. The tear-guide 21, as it rips the tear-sheet 20, will pull through the narrow opening 5 in the reservoir 1, and will pull under the plug 6. The slot 31 and the passage 3 will not be accidently blocked by an unevenly torn tear-sheet, so toner clogging is prevented. The tear-sheet 20 will not tear off prematurely. It only tears when the tear-guide 21 is pulled from the tear-sheet 20 by the end-user. The tear-guide 21 is removed completely from the reservoir 1. The toner cartridge assembly is then inserted into the imaging machine for operation.

Figure 12:
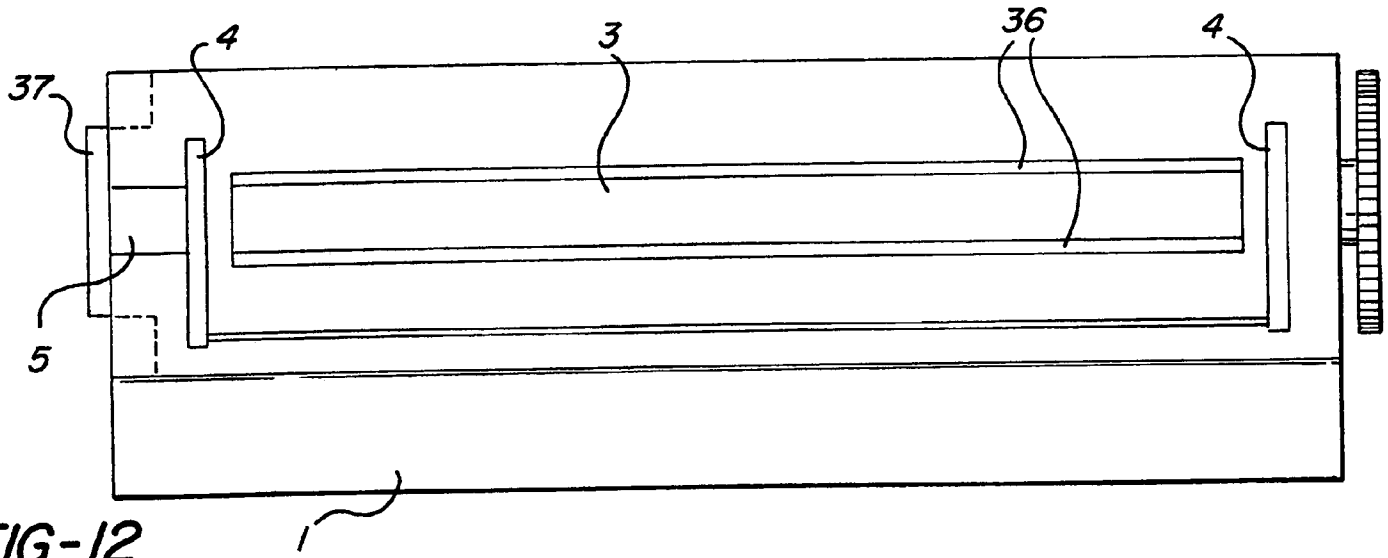
FIG-12 PRIOR ART
FIG. 12 is a partial top view of a prior art toner hopper with the remains of the OEM seal.

In some toner cartridge assemblies, such as the LX cartridge, it is convenient to use the remains of the OEM seal in the reservoir 1 as a seal-attach area for the seal-insert 28 or 32. FIG. 12 shows a partial top view of the passage 3 from the reservoir 1 of this type of cartridge. The remains of the OEM seal are flimsy and comprise two flexible strips 36 of seal material extending along the sides of the toner passage 3. The perimeter of the passage 3 in this case either does not exist or does not provide an adequate attach area for the aftermarket seal-insert 28 or 32 and the tear-seal 19. One cannot always pull out the old OEM seal remains because they are part of the cartridge assembly as originally constructed. It is difficult to attach the tear-seal 19 or seal-insert 28 or 32 to this flimsy, unstable surface area. When one presses down upon these flexible strips 36, adhesion is not always possible along the entire length of the seal. Typically, one presses down on the tear-seal 19 or seal-insert 28 or 32 with a flat screwdriver, burnishing tool, roller or similar aid to adhere the seal to the attach area. However, in some areas where the flexible strips 36 are pushed toward the inside of the reservoir 1, the new seal would be difficult or impossible to adhere because one cannot pull out the flimsy flexible strips 36 remaining from the OEM seal.

When the new tear-seal 19 or seal-insert 28 or 32 is not totally adhered to the flexible strips 36, toner pockets will be created. Since the LX cartridge reservoir 1 uses an inner paddle to drive toner through the passage 3 to the feed roller compartment 2, working against gravity, the toner pockets are vertical. These vertical toner pockets fill up with toner and eventually block the passage 3. This has actually been observed in the LX cartridge. Static electricity, the magnetic properties of toner, and other attractive properties within the assembly contribute to the problem, but even if the tear-sheet 20 and seal-insert 28 or 32 have antistatic properties, toner pockets will still form and may cause problems.

Applicant has come up with a new method for adhering the tear-seal 19 or seal-insert 28 or 32 to this flimsy attach area formed by the flexible strips 36 along the entire length of the passage 3 from the reservoir 1, preventing formation of toner pockets. By blowing air into the reservoir 1 or otherwise maintaining a positive air pressure inside the reservoir 1, usually from the toner fill port 37, the flimsy flexible strips 36 will be forced by air pressure to pull up or outward from the reservoir 1. The tear-seal 19 and seal-insert 28 or 32 are then pressed down or inward toward the reservoir 1, and the materials of the new seal and the remains of the OEM seal are adhered together along their entire lengths.

In this case, the flexible seal-insert 32 has the advantage of providing a more thorough or complete attachment to the remains of the OEM seal because the seal-insert 32 can be flexed or manipulated into contact with the strips 36 along the entire length of the passage 3. But the rigidness of the stiff seal-insert 28 makes it easier to apply. The width of the slot 31 of the seal-insert 28 does not spread or pinch as easily as the width of the slot 34 of the seal-insert 32, making the seal-insert 28 more stable.

Figure 13:
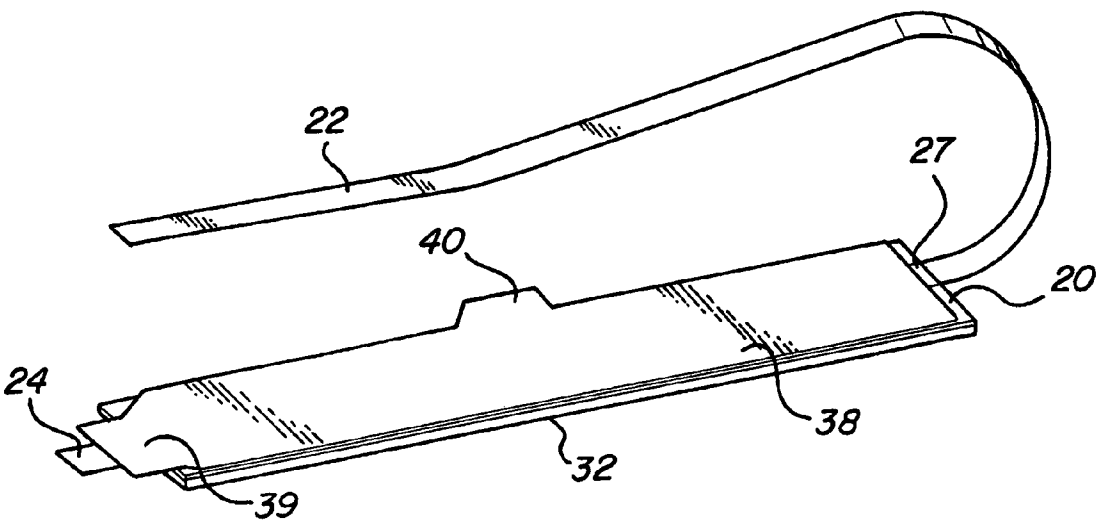
FIG. 13 shows a tear-seal and flexible seal-insert with a stiffener.

FIG. 13 shows a conventional device used to make the flexible seal-insert 32 more stable while it is being attached over the passage 3 from the reservoir 1. A long stiffener 38 of metal, cardboard, plastic or other rigid material is adhered by a removable glue, tape or other adhesive over the stiffener 38. By removable glue, applicants specify a glue similar to that used on POST-EM notes, a glue that peels off, and sticks to only one of the two surfaces, so, when one layer is peeled away, the peeled away layer has all the glue, and the other layer has no glue. The stiffener 38 may have a tab 39 extending from either of its ends and/or a tab 40 extending from somewhere along its length. The tabs 39 and 40 would not have adhesive on them, and would be used to easily pull the stiffener 38 off the seal after the seal is attached to the reservoir 1. This type of stiffener 38 has not been previously used with a tear-seal having a tear-sheet combined with the unique tear-guide 21 of this invention. The slot-setter described in applicant's U.S. Pat. No. 5,282,003 could also be used in place of the stiffener 38 for the same purpose, and the description of that slot-setter is hereby incorporated into this application.

Alternately, and this is an important part of the invention, for the flexible version of the seal, it may be difficult to apply the die-cut adhesive, which is very thin, in a precise fashion, onto the tear-seal. Among other methods of automation, for simple hand assembly, the adhesive will be thin and difficult to accurately put in place without it sticking all over the place in an undesirable way. To solve this problem, a thick, stiff paper or cardboard adhesive liner may be used, to provide stiffness to the adhesive or tape. Thus, hand assembly of this component is simplified.

It should be noted that one could use this type of tear-seal 19 and seal-insert 28 or 32 in a split hopper system. Some cartridges have a plastic gasket seam where two sections of the toner compartment join together. One section is the reservoir 1 and the other section is the cover or feed roller compartment. There are devices on the market that split the toner compartment into the two sections at this seam to put a new seal between the reservoir 1 and feed roller compartment. The sections are then joined back together using conventional clips, or any other joining means. The next time the cartridge needs to be refilled with toner, the sections do not have to be split. The clips are simply removed. The tear-seal 19 and seal-inserts 28 and 32 of this invention may be used in this type of system. Since there is really no seal-attach area, wider versions of the tear-seal and seal-insert are clamped between the sections. Foam, tape, or foam tape gaskets may be incorporated into the seal-insert as shown earlier in FIG. 3, for example. For split-hoppers, tape may be desired at both the top and bottom of the seal in many cases. For example, a tape seal-insert could be placed over the tear-sheet 20.

Figure 14:
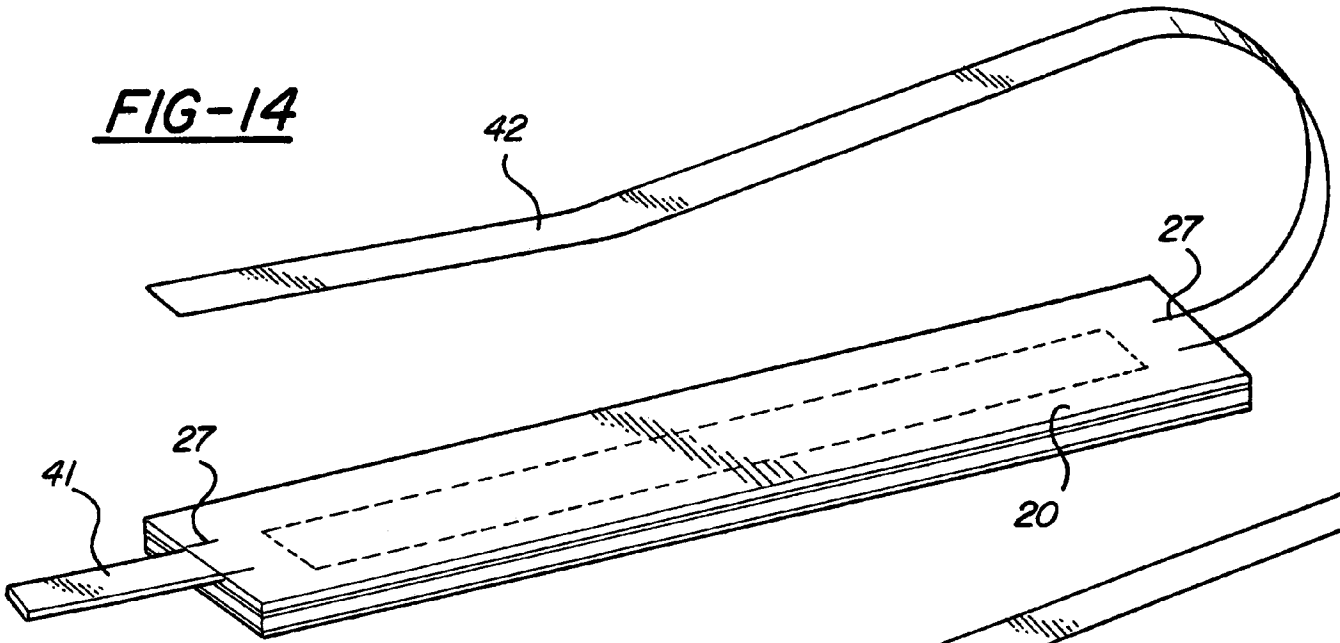
FIG. 14 shows an improved tear-sheet without using the unique tear-guide, but using a stiff seal-insert.
Figure 15:
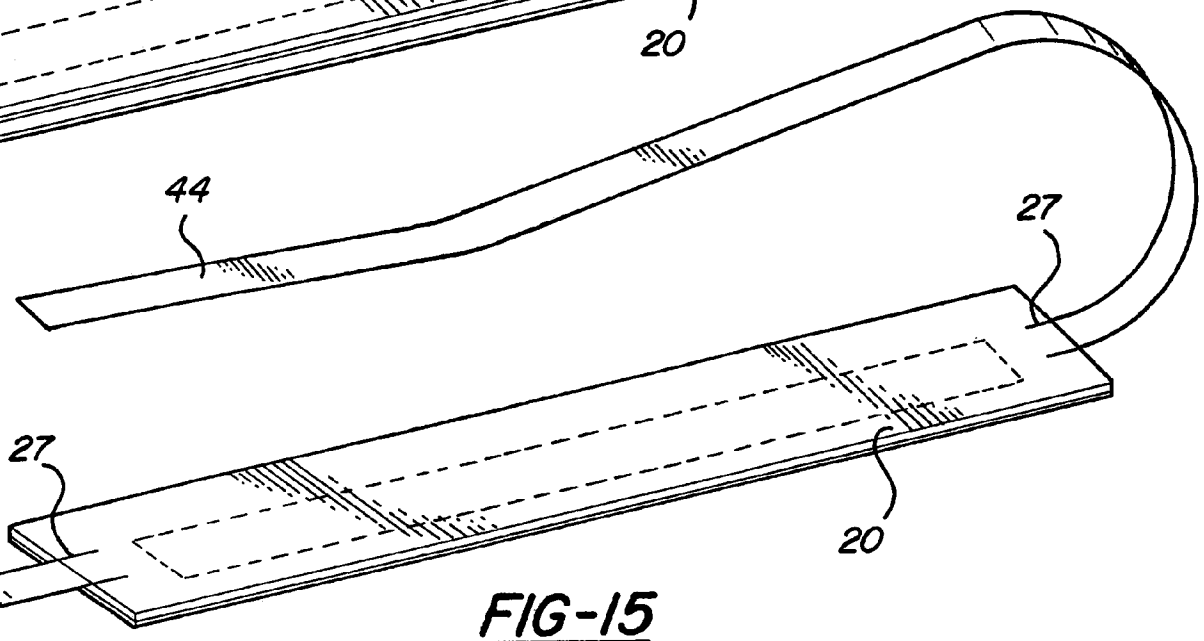
FIG. 15 shows a flexible version of this seal using a tear-seal but no tear-guide and using tape or adhesive for the seal-insert.

FIG. 14 shows an improved tear-sheet 20 without using the unique tear-guide 21. A short tail 41 is formed from the tear-sheet 20. The tail 41 extends from the tear-sheet 20 in the same manner that the short grip portion 24 of the tear-guide 21 extends from the end of the tear-seal 19. This is a significant improvement over the old tear-seal, because by gripping the tail 41 and the end of the long free length portion 42 adjacent the tear-sheet 20 and pulling the tear-seal taut, the tear-seal is much easier to adhere over the toner hopper passage 3. FIG. 14 shows the stiff version and FIG. 15 shows the flexible version using only tape as the seal-insert.

Figure 16:
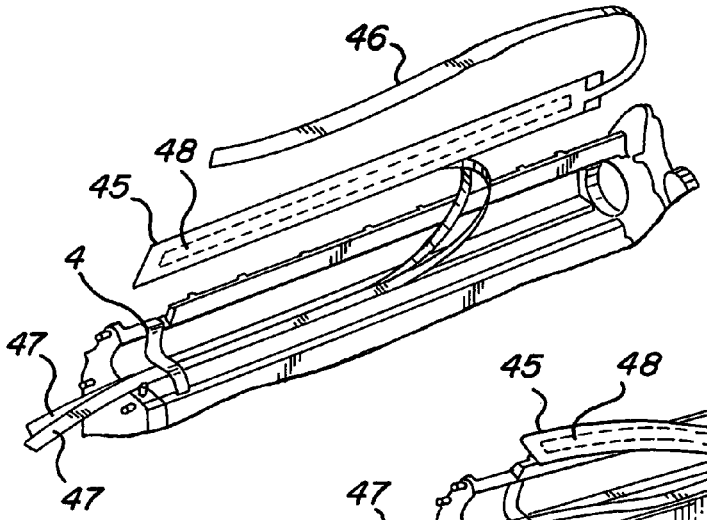
FIG-16 PRIOR ART
FIG. 16 shows a prior art seal system.
Figure 17:
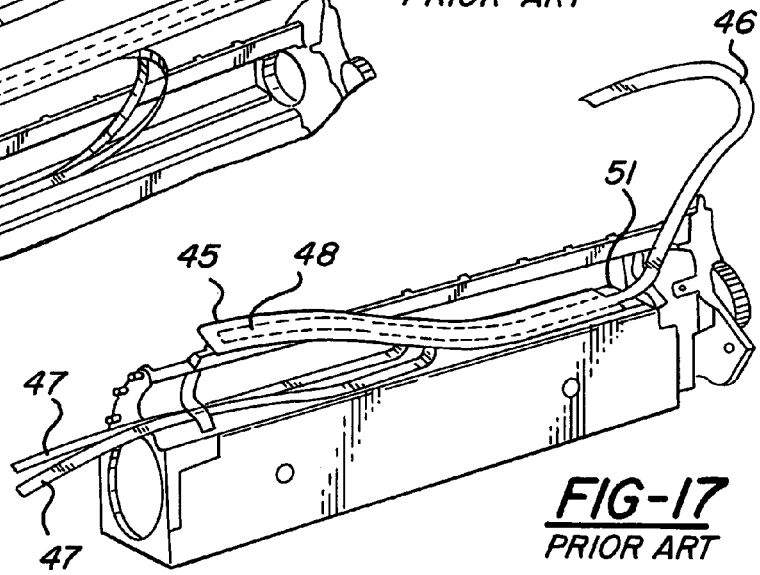
FIG-17 PRIOR ART
FIG. 17 shows the cumbersome installation required to install the prior art seal.
Figure 18:
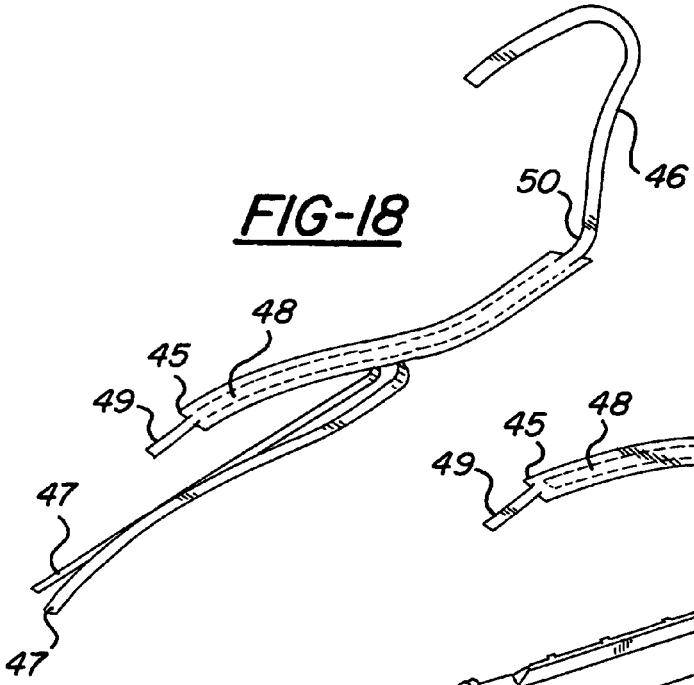
FIG. 18 shows an improved version of this seal system of FIG. 16, however, improved with an install tail, shown with the liner partially removed.
Figure 19:
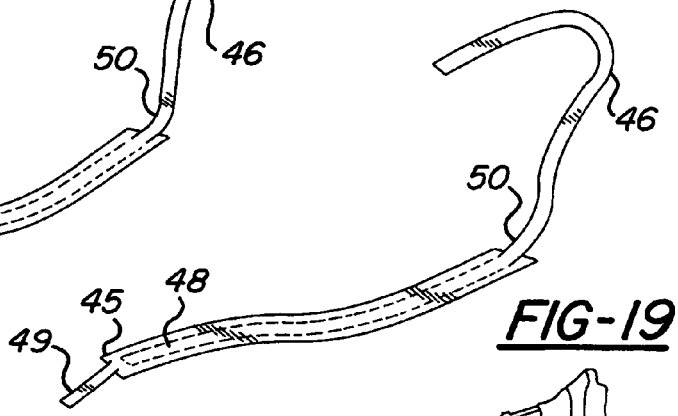
FIG. 19 shows this improved seal with the liner totally removed.
Figure 20:
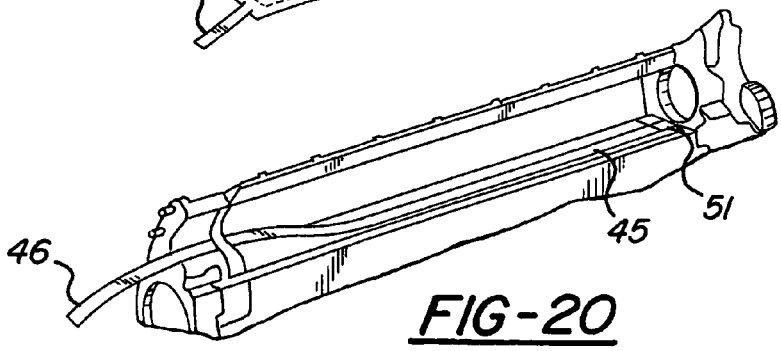
FIG. 20 shows this improved seal installed into an LX toner hopper.

The seal of U.S. Pat. No. 5,110,646 could also be improved for easy installation using some of the innovations of this invention. FIGS. 16–17 show a prior art seal of U.S. Pat. No. 5,110,646 as it is being installed into a reservoir 1. Installation is very cumbersome. If a mistake is made while installing, the seal may self-destruct because the adhesive may stick accidentally to the reservoir 1 walls or may stick to itself. First, the liner 47 is partially removed and slid under the felt 4. Then the right end 51 is partially stuck to the toner hopper 1*a*. Then the liner 47 is completely removed as the seal is pressed down. As demonstrated in this paragraph, this is very tedious and not very practical on a production basis although many such seals like this have been used. FIGS. 18–20 show an improved version of this seal system using a short grip portion 49. Thus, the installer may remove the entire liner as in FIGS. 18–19, pull on the short grip portion 49 with one hand and on the narrow portion 46 may pull it taut, analogous to FIG. 19, and then install it as in FIG. 20. This seal system may also be improved by using a tear-guide with or without the short grip portion 49 for further improvement. Also, this system may also be improved by using a stiff seal-insert 28 as in FIG. 8 to reinforce it for easier installation.

Since minor changes and modifications varied to fit particular operating requirements and environments will be understood by those skilled in the art, the invention is not considered limited to the specific examples chosen for purposes of illustration. The invention includes all changes and modifications which do not constitute a departure from the true spirit and scope of this invention as claimed in the following claims and as represented by reasonable equivalents to the claimed elements. Any ideas shown in any embodiments may be incorporated into any other embodiments. All references are to be considered as background art of this invention.

What is claimed is:

1. A device for sealing a toner passage in a toner hopper used in an image forming apparatus, said device including:

a pull-strip; and a main body portion including a layer of tear-able material, said tear-able material including a connecting region proximately located where said pull-strip is joined to said main body portion; and a first pre-cut and a second pre-cut proximately located in said connecting region, said first and second pre-cuts determining a location of an initial tear of said layer of tear-able material in said main body portion.

2. A device as in claim 1 whereby said pre-cuts begin at one end of said main body portion.

3. A device as in claim 1 whereby said pre-cuts are adjacent said pull-strip.

4. A device as in claim 1 whereby the spacing between said pre-cuts are about the same width as said pull-strip.

5. A device as in claim 1 whereby two pair of pre-cuts are present in said layer of tear-able material of said main body portion and whereby one pair of said pre-cuts is located at each said end of said tear-able layer of said main body portion.

6. A device as in claim 1 whereby a seal-insert has a first surface and a second surface; and whereby said layer of tear-able material is attached to said first surface of said seal-insert; and whereby said seal-insert is rectangular in shape; and whereby said seal-insert has an open region.

7. A device as in claim 6 whereby said seal-insert is made of a tape material that is pressure sensitive on both said first surface and on said second surface.

8. A device as in claim 7 whereby a release liner is attached to said pressure-sensitive surface on said second surface of said seal-insert.

9. A device as in claim 1 whereby said pull-strip comprises a free length portion of a tear-able material which is unitary with said layer of tear-able material.

10. A device as in claim 1 whereby said pull-strip comprises a tear-guide.

11. A device as in claim 1 whereby at least a portion of main body portion has a removable positioning support used for easier installation of said device.

12. A device for sealing a toner passage in a toner hopper used in an image forming apparatus, said device including:

a pull-strip; and a main body portion including a layer of tear-able material, said layer of tear-able material including a connecting region proximately located where said pull-strip joins said main body portion; and a first pre-cut and a second pre-cut proximately located in said connecting region, said first and second pre-cuts determining a location of an initial tear of said layer of tear-able material in said main body portion; and whereby said pull-strip is made conductive either by impregnating conductive material into said pull-strip or by coating said pull-strip with a conductive coating.

13. A device for sealing a toner passage in a toner hopper used in an image forming apparatus, said device including:

a pull-strip; and a main body portion including a layer of tear-able material, said tear-able material including a connecting region proximately located where said pull-strip joins said main body portion; and a first pre-cut and a second pre-cut proximately located in said connecting region, said first and second precuts determining a location of an initial tear of said layer of tear-able material in said main body portion; and whereby a seal-insert has a first surface and a second surface; and whereby said layer of tear-able material is attached to said first surface of said seal-insert; and whereby said seal-insert is rectangular in shape; and whereby said seal-insert has an open region; and whereby said seal-insert includes a plastic permanent support layer with two faces whereby each said face includes a layer of tape, glue or adhesive.

14. A device as in claim 13 whereby a release liner is attached to said layer of tape, glue or adhesive on said second surface of said seal-insert.

15. A device for sealing a toner passage in a toner hopper used in an image forming apparatus, said device including:

a pull-strip; and a main body portion including a layer of tear-able material, said tear-able material including a joining region proximately located where said pull-strip joins said main body portion; and a first pre-cut and a second pre-cut proximately located in said joining region, said first and second precuts determining a location of an initial tear of said layer of tear-able material in said main body portion.

16. A device as in claim 15 whereby said pre-cuts begin at one end of said main body portion.

17. A device as in claim 15 whereby said pre-cuts are adjacent said pull-strip.

18. A device as in claim 15 whereby the spacing between said pre-cuts are about the same width as said pull-strip.

19. A device as in claim 15 whereby two pair of pre-cuts are present in said layer of tear-able material of said main body portion and whereby one pair of said pre-cuts is located at each said end of said tear-able layer of said main body portion.

20. A device as in claim 15 whereby a seal-insert has a first surface and a second surface; and whereby said layer of tear-able material is attached to said first surface of said seal-insert; and whereby said seal-insert is rectangular in shape; and whereby said seal-insert has an open region.

21. A device as in claim 20 whereby said seal-insert is made of a tape material that is pressure sensitive on both said first surface and on said second surface.

22. A device as in claim 21 whereby a release liner is attached to said pressure-sensitive surface on said second surface of said seal-insert.

23. A device as in claim 15 whereby said pull-strip comprises a free length portion of a tear-able material which is unitary with said layer of tear-able material.

24. A device as in claim 15 whereby said pull-strip comprises a tear-guide.

25. A device as in claim 15 whereby at least a portion of main body portion has a removable positioning support used for easier installation of said device.

26. A device for sealing a toner passage in a toner hopper used in an image forming apparatus, said device including:

a pull-strip; and a main body portion including a layer of tear-able material, said tear-able material including a joining region proximately located where said pull-strip is joined to said main body portion; and a first pre-cut and a second pre-cut proximately located in said joining region, said first and second pre-cuts determining a location of an initial tear of said layer of tear-able material in said main body portion; and whereby said pull-strip is made conductive either by impregnating conductive material into said pull-strip or by coating said pull-strip with a conductive coating.

27. A device for sealing a toner passage in a toner hopper used in an image forming apparatus, said device including:

a pull-strip; and a main body portion including a layer of tear-able material, said tear-able material including a joining region proximately located where said pull-strip is joined to said main body portion; and a first pre-cut and a second pre-cut proximately located in said joining region, said first and second pre-cuts determining a location of an initial tear of said layer of tear-able material in said main body portion; and whereby a seal-insert has a first surface and a second surface; and whereby said layer of tear-able material is attached to said first surface of said seal-insert; and whereby said seal-insert is rectangular in shape; and whereby said seal-insert has an open region; and whereby said seal-insert includes a permanent support plastic layer with two faces whereby each said face is attached to a layer of tape, glue or adhesive.

28. A device as in claim 27 whereby a release liner is attached to said layer of tape, glue or adhesive on said second surface of said seal-insert.

29. A device for sealing a toner passage in a toner hopper used in an image forming apparatus, said device including:

a pull-strip; and a main body portion including a layer of tear-able material, said tear-able material including an intersecting region proximately located where said pull-strip is attached to said main body portion; and a first precut and a second pre-cut proximately located in said intersecting region, said first and second pre-cuts determining a location of an initial tear of said layer of tear-able material in said main body portion.

30. A device as in claim 29 whereby said pre-cuts begin at one end of said main body portion.

31. A device as in claim 29 whereby said pre-cuts are adjacent said pull-strip.

32. A device as in claim 29 whereby the spacing between said pre-cuts are about the same width as said pull-strip.

33. A device as in claim 29 whereby two pair of pre-cuts are present in said layer of tear-able material of said main body portion and whereby one pair of said pre-cuts is located at each said end of said tear-able layer of said main body portion.

34. A device as in claim 29 whereby a seal-insert has a first surface and a second surface; and whereby said layer of tear-able material is adhered to said first surface of said seal-insert; and whereby said seal-insert is rectangular in shape; and whereby said seal-insert has an open region.

35. A device as in claim 34 whereby said seal-insert is made of a tape material that is pressure sensitive on both said first surface and on said second surface.

36. A device as in claim 35 whereby a release liner is attached to said pressure-sensitive surface on said second surface of said seal-insert.

37. A device as in claim 29 whereby said pull-strip comprises a free length portion of tear-able material which is unitary with said layer of tear-able material.

38. A device as in claim 29 whereby said pull-strip comprises a tear-guide.

39. A device as in claim 29 whereby at least a portion of main body portion has a removable positioning support used for easier installation of said device.

40. A device for sealing a loner passage in a toner hopper used in an image forming apparatus, said device including:

a pull-strip; and a main body portion including a layer of tear-able material, said tear-able material including an intersecting region proximately located where said pull-strip is attached to said main body portion; and a first pre-cut and a second pre-cut proximately located in said intersecting region, said first and second pre-cuts determining a location of an initial tear of said layer of tear-able material in said main body portion; and whereby said pull-strip is made conductive either by impregnating conductive material into said pull-strip or by coating said pull-strip with a conductive coating.

41. A device for sealing a toner passage in a toner hopper used in an image forming apparatus, said device including:

a pull-strip; and a main body portion including a layer of tear-able material, said tear-able material including an intersecting region proximately located where said pull-strip is attached to said main body portion; and a first pre-cut and a second pre-cut proximately located in said intersecting region, said first and second pre-cuts determining a location of an initial tear of said layer of tear-able material in said main body portion; and whereby a seal-insert has a first surface and a second surface; and whereby said layer of tear-able material is attached to said first surface of said seal-insert; and whereby said seal-insert is rectangular in shape; and whereby said seal-insert has an open region; and whereby said seal-insert includes a permanent support plastic layer with two faces whereby each said face is attached to a layer of tape, glue or adhesive.

42. A device as in claim 41 whereby a release liner is attached to said layer of tape, glue or adhesive on said second surface of said seal-insert.

43. A toner hopper used in an image forming apparatus comprising of a dry toner style printer, copy machine or facsimile machine;

whereby said toner hopper includes a reservoir and a feed roller compartment; and whereby said reservoir is used to store a powdered toner; and whereby said feed roller compartment includes a roller used to dispense said powdered toner; and whereby said toner hopper includes a seal assembly between said reservoir and said feed roller compartment; and whereby said seal assembly includes a pull-strip; and a main body portion including a layer of tear-able material, said tear-able material including a connecting region proximately located where said pull-strip is attached to said main body portion; and a first pre-cut and a second pre-cut proximately located in said connecting region, said first and second pre-cuts determining a location of an initial tear of said layer of tear-able material in said main body portion.

44. A toner hopper as in claim 43 whereby said pre-cuts begin at one end of said main body portion.

45. A toner hopper as in claim 43 whereby said pre-cuts are adjacent said pull-strip.

46. A toner hopper as in claim 43 whereby the spacing between said pre-cuts are about the same width as said pull-strip.

47. A toner hopper as in claim 43 whereby two pair of pre-cuts are present in said layer of tear-able material of said main body portion and whereby one pair of said pre-cuts is located at each said end of said tear-able layer of said main body portion.

48. A toner hopper as in claim 43 whereby a seal-insert has a first surface and a second surface; and whereby said layer of tear-able material is attached to said first surface of said seal-insert; and whereby said seal-insert is rectangular in shape; and whereby said seal-insert has an open region.

49. A toner hopper as in claim 48 whereby said seal-insert is made of a tape material that is pressure sensitive on both said first surface and on said second surface.

50. A toner hopper as in claim 43 whereby said pull-strip comprises a free length portion of tear-able material which is unitary with said layer of tear-able material.

51. A toner hopper as in claim 43 whereby said pull-strip comprises a tear-guide.

52. A toner hopper used in an image forming apparatus comprising of a dry toner style printer, copy machine or facsimile machine;

whereby said toner hopper includes a reservoir and a feed roller compartment; and whereby said reservoir is used to store a powdered toner; and whereby said feed roller compartment includes a roller used to dispense said powdered toner; and whereby said toner hopper includes a seal assembly between said reservoir and said feed roller compartment; and whereby said seal assembly includes a pull-strip; and a main body portion including a layer of tear-able material, said tear-able material including a joining region proximately located where said pull-strip is attached to said main body portion; and a first pre-cut and a second pre-cut proximately located in said connecting region, said first and second precuts determining a location of an initial tear of said layer of tear-able material in said main body portion; and whereby said pull-strip is made conductive either by impregnating conductive material into said pull-strip or by coating said pull-strip with a conductive coating.

53. A toner hopper used in an image forming apparatus comprising of a dry toner style printer, copy machine or facsimile machine;

whereby said toner hopper includes a reservoir and a feed roller compartment; and whereby said reservoir is used to store a powdered toner; and whereby said feed roller compartment includes a roller used to dispense said powdered toner; and whereby said toner hopper includes a seal assembly between said reservoir and said feed roller compartment; and whereby said seal assembly includes a pull-strip; and a main body portion including a layer of tear-able material, said tear-able material including a joining region proximately located where said pull-strip is attached to said main body portion; and a first pre-cut and a second pre-cut proximately located in said connecting region, said first and second pre-cuts determining a location of an initial tear of said layer of tear-able material in said main body portion; and whereby a seal-insert has a first surface and a second surface; and whereby said layer of tear-able material is attached to said first surface of said seal-insert; and whereby said seal-insert is rectangular in shape; and whereby said seal-insert has an open region; and whereby said seal-insert includes a permanent support plastic layer with two faces whereby each said face is attached to a layer of tape, glue or adhesive.

54. A toner cartridge assembly used in an image forming apparatus comprising of a dry toner style printer, copy machine or facsimile machine;

whereby said toner cartridge assembly includes a toner hopper and a photoreceptor housing; and whereby said photoreceptor housing includes a photoreceptor, a cleaning blade and a charging device for electrostatically charging said photoreceptor and whereby said toner hopper includes a reservoir and a feed roller compartment; and whereby said reservoir is used to store a powdered toner; and whereby said feed roller compartment has a roller used to dispense toner; and whereby said toner hopper includes a seal assembly; and whereby said seal assembly includes a pull-strip; and a main body portion including a layer of tear-able material, said tear-able material including a connecting region proximately located where said pull-strip is attached to said main body portion; and a first pre-cut and a second pre-cut proximately located in said connecting region, said first and second precuts determining a location of an initial tear of said layer of tear-able material in said main body portion.

55. A toner cartridge as in claim 54 whereby said pre-cuts begin at one end of said main body portion.

56. A toner cartridge as in claim 54 whereby said pre-cuts are adjacent said pull-strip.

57. A toner cartridge as in claim 54 whereby the spacing between said pre-cuts are about the same width as said pull-strip.

58. A toner cartridge as in claim 54 whereby two pair of pre-cuts are present in said layer of tear-able material of said main body portion and whereby one pair of said pre-cuts is located at each said end of said tear-able layer of said main body portion.

59. A toner cartridge as in claim 54 whereby a seal-insert has a first surface and a second surface; and whereby said layer of tear-able material is attached to said first surface of said seal-insert; and whereby said seal-insert is rectangular in shape; and whereby said seal-insert has an open region.

60. A toner cartridge as in claim 54 whereby said seal-insert is made of a tape material that is pressure sensitive on both said first surface and on said second surface.

61. A toner cartridge as in claim 54 whereby said pull-strip comprises a free length portion of tear-able material which is unitary with said layer of tear-able material.

62. A toner cartridge as in claim 54 whereby said pull-strip comprises a tear-guide.

63. A toner cartridge assembly used in an image forming apparatus comprising of a dry style printer, copy machine or facsimile machine;

whereby said cartridge assembly includes a hopper and a photoreceptor housing; and whereby said photoreceptor housing includes a photoreceptor, a cleaning blade and a charging device for electrostatically charging said photoreceptor; and whereby said hopper includes a reservoir and a feed roller compartment; and whereby said reservoir is used to store a powdered toner; and whereby said feed roller compartment has a roller used to dispense said powdered toner; and whereby said toner hopper includes a seal assembly; and whereby said seal assembly includes a pull-strip; and a main body portion including a layer of tear-able material, said tear-able material including a joining region proximately located where said pull-strip is attached to said main body portion; and a first pre-cut and a second pre-cut proximately located in said joining region, said first and second precuts determining a location of an initial tear of said layer of tear-able material in said main body portion; and whereby said pull-strip is made conductive either by impregnating conductive material into said pull-strip or by coating said pull-strip with a conductive coating.

64. A toner cartridge assembly used in an image forming apparatus comprising of a dry toner style printer, copy machine or facsimile machine;

whereby said toner cartridge assembly includes a toner hopper and a photoreceptor housing; and whereby said photoreceptor housing includes a photoreceptor, a cleaning blade and a charging device for electrostatically charging said photoreceptor; and whereby said toner hopper includes a reservoir and a feed roller compartment; and whereby said reservoir is used to store a powdered toner; and whereby said feed roller compartment has a roller used to dispense said powdered toner; and whereby said toner hopper includes a seal assembly; and whereby said seal assembly includes a pull-strip; and a main body portion including a layer of tear-able material, said tear-able material including a joining region proximately located where said pull-strip is attached to said main body portion; and a first pre-cut and a second precut proximately located in said connecting region, said first and second pre-cuts determining a location of an initial tear of said layer of tear-able material in said main body portion; and whereby a seal-insert has a first surface and a second surface; and whereby said layer of tear-able material is attached to said first surface of said seal-insert; and whereby said seal-insert is rectangular in shape; and whereby said seal-insert has an open region; and whereby said seal-insert includes a permanent support plastic layer with two faces whereby each said face is attached to a layer of tape, glue or adhesive.

65. An image forming apparatus comprising of a dry toner style printer, copy machine or facsimile machine;

whereby said image forming apparatus includes a toner storage container, a photoreceptor housing including a photoreceptor, a cleaning blade, and a photoreceptor charging device; and whereby said toner storage container has a storage tank; and whereby said storage tank includes a seal assembly, and whereby said seal assembly includes a pull-strip; and a main body portion including a layer of tear-able material, said tear-able material including a joining region proximately located where said pull-strip is attached to said main body portion; and a first pre-cut and a second pre-cut proximately located in said connecting region, said first and second pre-cuts determining a location of an initial tear of said layer of tear-able material in said main body portion.

66. An image forming apparatus as in claim 65 whereby said pre-cuts begin at one end of said main body portion.

67. An image forming apparatus as in claim 65 whereby said precuts are adjacent said pull-strip.

68. An image forming apparatus as in claim 65 whereby the spacing between said pre-cuts are about the same width as said pull-strip.

69. An image forming apparatus as in claim 65 whereby two pair of pre-cuts are present in said layer of tear-able material of said main body portion and whereby one pair of said pre-cuts is located at each said end of said tear-able layer of said main body portion.

70. An image forming apparatus as in claim 65 whereby a seal-insert has a first surface and a second surface; and whereby said layer of tear-able material is attached to said first surface of said seal-insert; and whereby said seal-insert is rectangular in shape; and whereby said seal-insert has an open region.

71. An image forming apparatus as in claim 70 whereby said seal-insert is made of a tape material that is pressure sensitive on both said first surface and on said second surface.

72. An image forming apparatus as in claim 65 whereby said pull-strip comprises a free length portion of tear-able material which is unitary with said layer of tear-able material.

73. An image forming apparatus as in claim 65 whereby said pull-strip comprises a tear-guide.

74. An image forming apparatus comprising of a dry toner style printer, copy machine or facsimile machine;

whereby said image forming apparatus includes a toner storage container, a photoreceptor housing including a photoreceptor, a cleaning blade, and a photoreceptor charging device; and whereby said toner storage container has a storage tank; and whereby said storage tank includes a seal assembly; and whereby said seal assembly includes a pull-strip; and a main body portion including a layer of tear-able material, said tear-able material including a connecting region proximately located where said pull-strip is connected to said main body portion; and a first pre-cut and a second pre-cut proximately located in said connecting region, said first and second pre-cuts determining a location of an initial tear of said layer of tear-able material in said main body portion; and whereby said pull-strip is made conductive either by impregnating conductive material into said pull-strip or by coating said pull-strip with a conductive coating.

75. An image forming apparatus comprising of a dry toner style printer, copy machine or facsimile machine;

whereby said image forming apparatus contains a toner storage container, a photoreceptor, a cleaning blade and a photoreceptor charging device;

whereby said toner storage container has a storage tank; and whereby said storage tank includes a seal assembly; and whereby said seal assembly includes a pull-strip; and a main body portion including a layer of tear-able material, said tear-able material including a joining region proximately located where said pull-strip is connected to said main body portion; and a first pre-cut and a second pre-cut proximately located in said connecting region, said first and second precuts determining a location of an initial tear of said layer of tear-able material in said main body portion; and whereby a seal-insert has a first surface and a second surface; and whereby said layer of tear-able material is attached to said first surface of said seal-insert; and whereby said seal-insert is rectangular in shape; and whereby said seal-insert has an open region; and whereby said seal-insert includes a permanent support plastic layer with two faces whereby each said face is attached to a layer of tape, glue or adhesive.

76. An image forming apparatus comprising of a dry toner style printer, copy machine or facsimile machine;

whereby said image forming apparatus makes an image on media;

whereby said image forming apparatus includes a toner cartridge assembly and whereby said toner cartridge assembly includes a toner hopper and a photoreceptor housing; and whereby said photoreceptor housing includes a photoreceptor, a cleaning blade and a charging device for electrostatically charging said photoreceptor and a container to receive waste toner; and whereby said toner hopper includes a reservoir and a feed roller compartment; and whereby said reservoir is used to store a powdered toner; and whereby said feed roller compartment has a roller used to dispense said powdered toner; and whereby said toner hopper includes a seal assembly between said reservoir and said feed roller compartment; and whereby said seat assembly includes a pull-strip; and a main body portion including a layer of tear-able material, said tear-able material including a joining region proximately located where said pull-strip is connected to said main body portion; and a first pre-cut and a second pre-cut proximately located in said connecting region, said first and second pre-cuts determining a location of an initial tear of said layer of tear-able material in said main body portion.

77. An image forming apparatus as in claim 76 whereby said pre-cuts begin at one end of said main body portion.

78. An image forming apparatus as in claim 76 whereby said pre-cuts are adjacent said pull-strip.

79. An image forming apparatus as in claim 76 whereby the spacing between said pre-cuts are about the same width as said pull-strip.

80. An image forming apparatus as in claim 76 whereby two pair of pre-cuts are present in said layer of tear-able material of said main body portion and whereby one pair of said pre-cuts is located at each said end of said tear-able layer of said main body portion.

81. An image forming apparatus as in claim 76 whereby a seal-insert has a first surface and a second surface; and whereby said layer of tear-able material is attached to said first surface of said seal-insert; and whereby said seal-insert is rectangular in shape; and whereby said seal-insert has an open region.

82. An image forming apparatus as in claim 81 whereby said seal-insert is made of a tape material that is pressure sensitive on both said first surface and on said second surface.

83. An image forming apparatus as in claim 76 whereby said pull-strip comprises a tail which is unitary with said layer of tear-able material.

84. An image forming apparatus as in claim 76 whereby said pull-strip comprises a tear-guide.

85. An image forming apparatus comprising of a dry toner style printer, copy machine or facsimile machine;

whereby said image forming apparatus includes a toner cartridge assembly and whereby said toner cartridge assembly includes a toner hopper and a photoreceptor housing; and whereby said photoreceptor housing includes a photoreceptor, a cleaning blade and a charging device for electrostatically charging said photoreceptor; and whereby said toner hopper includes a reservoir and a feed roller compartment; and whereby said reservoir is used to store a powdered toner; and whereby said feed roller compartment has a roller used to dispense said powdered toner; and whereby said toner hopper includes a seal assembly between said reservoir and said feed roller compartment; and whereby said seal assembly includes a pull-strip; and a main body portion including a layer of tear-able material, said tear-able material including a connecting region proximately located where said pull-strip is attached to said main body portion; and a first pre-cut and a second pre-cut proximately located in said connecting region, said first and second pre-cuts determining a location of an initial tear of said layer of tear-able material in said main body portion; and whereby said pull-strip is made conductive either by impregnating conductive material into said pull-strip or by coating said pull-strip with a conductive coating.

86. An image forming apparatus comprising of a dry toner style printer, copy machine or facsimile machine;

whereby said image forming apparatus includes a toner cartridge assembly and whereby said toner cartridge assembly includes a toner hopper and a photoreceptor housing; and whereby said photoreceptor housing includes a photoreceptor, a cleaning blade and a charging device for electrostatically charging said photoreceptor; and whereby said toner hopper includes a reservoir and a feed roller compartment; and whereby said reservoir is used to store a powdered toner; and whereby said feed roller compartment has a roller used to dispense said powdered toner; and whereby said toner hopper includes a seal assembly between said reservoir and said feed roller compartment; and whereby said seal assembly includes a pull-strip; and a main body portion including a layer of tear-able material, said tear-able material including a joining region proximately located where said pull-strip is connected to said main body portion; and a first pre-cut and a second pre-cut proximately located in said connecting region, said first and second pre-cuts determining a location of an initial tear of said layer of tear-able material in said main body portion; and whereby a seal-insert has a first surface and a second surface; and whereby said layer of tear-able material is attached to said first surface of said seal-insert; and whereby said seal-insert is rectangular in shape; and whereby said seal-insert has an open region; and whereby said seal-insert includes a permanent support plastic layer with two faces whereby each said face is attached to a layer of tape, glue or adhesive.

87. A method of manufacturing a device for sealing a toner passage in a toner hopper used in printers, copying machines, facsimile machines, toner cartridges used therein, or any image forming apparatus:

whereby said method includes the step of manufacturing a pull-strip; and whereby said method also includes the step of making a main body portion including a layer of tear-able material, where the tear-able material includes a connecting region proximately located where the pull-strip is attached to the main body portion; and whereby said method also includes the step of forming a first pre-cut and a second pre-cut proximately located in the connecting region, whereby the first and second pre-cuts determine a location of an initial tear of the layer of tear-able material in the main body portion.

88. A method as in claim 87 whereby said method includes making pre-cuts that begin at one end of the main body portion.

89. A method as in claim 87 whereby said method includes making the pre-cuts adjacent to the pull-strip.

90. A method as in claim 87 whereby said method includes making the precuts about the same width as the pull-strip.

91. A method as in claim 87 whereby said method includes making two pair of pre-cuts in the layer of tear-able material of the main body portion and whereby one pair of the pre-cuts is located at each end of the layer of tear-able material of the main body portion.

92. A method as in claim 87 whereby a seal-insert has a first surface and a second surface; and whereby said method includes attaching the layer of tear-able material to the first surface of the seal-insert; and whereby the seal-insert is rectangular in shape; and whereby the seal-insert has an open region.

93. A method as in claim 92 whereby said method includes manufacturing the seal-insert using a tape material that is pressure sensitive on both first surface and on second surface.

94. A method as in claim 93 whereby said method includes attaching a release liner to the second surface of the seal-insert.

95. A method as in claim 87 whereby said method includes attaching a release liner to the layer of tape, glue or adhesive on the second surface of the seal-insert.

96. A method as in claim 87 whereby the pull-strip comprises a free length portion of tear-able material which is unitary with the layer of tear-able material.

97. A method as in claim 87 whereby the pull-strip comprises a tear-guide.

98. A method as in claim 87 whereby said method includes placing a removable positioning support over at least a portion of main body portion for easier installation of the device.

99. A method of manufacturing a device for sealing a toner passage in a toner hopper used in printers, copying machines, facsimile machines, toner cartridges used therein, or any image forming apparatus:

whereby said method includes the step of manufacturing a pull-strip; and whereby said method also includes the step of making a main body portion including a layer of tear-able material, where the tear-able material includes a connecting region proximately located where the pull-strip is attached to the main body portion; and whereby said method also includes the step of forming a first pre-cut and a second pre-cut proximately located in the connecting region, whereby the first and second pre-cuts determine a location of an initial tear of the layer of tear-able material in the main body portion; and whereby said method includes a step whereby the pull-strip is made conductive either by impregnating conductive material into the pull-strip or by coating the pull-strip with a conductive coating.

100. A method of manufacturing a device for sealing a toner passage in a toner hopper used in printers, copying machines, facsimile machines, toner cartridges used therein, or any image forming apparatus:

whereby said method includes the step of manufacturing a pull-strip; and whereby said method also includes the step of making a main body portion including a layer of tear-able material, where the tear-able material includes a connecting region proximately located where the pull-strip is attached to the main body portion; and whereby said method also includes the step of forming a first pre-cut and a second pre-cut proximately located in the connecting region, whereby the first and second pre-cuts determine a location of an initial tear of the layer of tear-able material in the main body portion; and whereby a seal-insert has a first surface and a second surface; and whereby said method includes attaching the layer of tear-able material to the first surface of the seal-insert; and whereby the seal-insert is rectangular in shape; and whereby the seal-insert has an open region; and whereby said method includes manufacturing the seal-insert using a permanent support plastic layer with two faces whereby each face is attached to a layer of tape, glue or adhesive.

101. A method of manufacturing a toner hopper used in an image forming apparatus comprising of a dry toner style printer, copy machine or facsimile machine;

whereby the toner hopper includes a reservoir and a feed roller compartment; and whereby the reservoir is used to store a powdered toner; and whereby the feed roller compartment includes a roller used to dispense the powdered toner; and whereby the toner hopper includes a seal assembly between the reservoir and the feed roller compartment; and whereby said method includes the step of manufacturing the seal assembly; and whereby the seal assembly includes a pull-strip and a layer of tear-able material; and whereby said method includes the step of manufacturing a pull-strip; and whereby said method also includes the step of making a main body portion including the layer of tear-able material, where the tear-able material includes a connecting region proximately located where the pull-strip is attached to the main body portion; and whereby said method also includes the step of forming a first pre-cut and a second pre-cut proximately located in the connecting region, whereby the first and second pre-cuts determine a location of an initial tear of the layer of tear-able material in the main body portion; and whereby said method includes the step of attaching the seal assembly to the toner hopper.

102. A method as in claim 101 whereby said method includes making pre-cuts begin at one end of the main body portion.

103. A method as in claim 101 whereby said method includes making the pre-cuts adjacent to the pull-strip.

104. A method as in claim 101 whereby said method includes making the spacing between the pre-cuts about the same width as the pull-strip.

105. A method as in claim 101 whereby said method includes making two pair of pre-cuts in the layer of tear-able material of the main body portion and whereby one pair of the pre-cuts is located at each end of the layer of tear-able material of the main body portion.

106. A method as in claim 101 whereby a seal-insert has a first surface and a second surface; and whereby said method includes attaching the layer of tear-able material to the first surface of the seal-insert; and whereby the seal-insert is rectangular in shape; and whereby the seal-insert has an open region.

107. A method as in claim 106 whereby said method includes manufacturing the seal-insert using a tape material that is pressure sensitive on both first surface and on second surface.

108. A method as in claim 101 whereby a pull-strip comprises a free length portion of tear-able material which is unitary with the layer of tear-able material.

109. A method as in claim 101 whereby the pull-strip comprises a tear-guide.

110. A method of manufacturing a toner hopper used in an image forming apparatus comprising of a dry toner style printer, copy machine or facsimile machine;

whereby the toner hopper includes a reservoir and a feed roller compartment; and whereby the reservoir is used to store a powdered toner; and whereby the feed roller compartment includes a roller used to dispense the powdered toner; and whereby the toner hopper includes a seal assembly between the reservoir and the feed roller compartment; and whereby said method includes the step of manufacturing the seal assembly; and whereby the seal assembly includes a pull-strip and a layer of tear-able material; and whereby said method includes the step of manufacturing a pull-strip; and whereby said method also includes the step of making a main body portion including the layer of tear-able material, where the tear-able material includes a joining region proximately located where the pull-strip is attached to the main body portion; and whereby said method also includes the step of forming a first pre-cut and a second pre-cut proximately located in the connecting region, whereby the first and second pre-cuts determine a location of an initial tear of the layer of tear-able material in the main body portion; and whereby said method includes the step of attaching the seal assembly to the toner hopper; and whereby said method includes a step whereby the pull-strip is made conductive either by impregnating conductive material into the pull-strip or by coating the pull-strip with a conductive coating.

111. A method of manufacturing a toner hopper used in an image forming apparatus comprising of a dry toner style printer, copy machine or facsimile machine;

whereby the toner hopper includes a reservoir and a feed roller compartment; and whereby the reservoir is used to store a powdered toner; and whereby the feed roller compartment includes a roller used to dispense the powdered toner; and whereby the toner hopper includes a seal assembly between the reservoir and the feed roller compartment; and whereby said method includes the step of manufacturing the seal assembly; and whereby the seal assembly includes a pull-strip and a layer of tear-able material; and whereby said method includes the step of manufacturing a pull-strip; and whereby said method also includes the step of making a main body portion including the layer of tear-able material, where the tear-able material includes a connecting region proximately located where the pull-strip is attached to the main body portion; and whereby said method also includes the step of forming a first pre-cut and a second pre-cut proximately located in the connecting region, whereby the first and second pre-cuts determine a location of an initial tear of the layer of tear-able material in the main body portion; and whereby said method includes the step of attaching the seal assembly to the toner hopper; and whereby a seal-insert has a first surface and a second surface; and whereby said method includes attaching the layer of tear-able material to the first surface of the seal-insert; and whereby the seal-insert is rectangular in shape; and whereby the seal-insert has an open region; and whereby said method includes manufacturing the seal-insert using a permanent support plastic layer with two faces whereby each face is attached to a layer of tape, glue or adhesive.

112. A method of manufacturing a toner cartridge assembly used in an image forming apparatus;

whereby said method includes a step of assembling a toner hopper and a photoreceptor housing to make a toner cartridge assembly; and whereby the photoreceptor housing includes a photoreceptor, a cleaning blade and a charging device for electrostatically charging the photoreceptor; and whereby the toner hopper includes a reservoir and a feed roller compartment; and whereby the reservoir is used to store a powdered toner; and whereby the feed roller compartment has a roller used to dispense the powdered toner; and whereby the toner hopper includes a seal assembly between the reservoir and the feed roller compartment; and whereby said method includes the step of manufacturing the seal assembly; and whereby the seal assembly includes a pull-strip and a layer of tear-able material; and whereby said method includes the step of manufacturing a pull-strip; and whereby said method also includes the step of making a main body portion including the layer of tear-able material, where the tear-able material includes a connecting region proximately located where the pull-strip is attached to the main body portion; and whereby said method also includes the step of forming a first pre-cut and a second pre-cut proximately located in the connecting region, whereby the first and second pre-cuts determine a location of an initial tear of the layer of tear-able material in the main body portion; and whereby said method includes the step of attaching the seal assembly to the toner hopper.

113. A method as in claim 112 whereby said method includes making pre-cuts begin at one end of the main body portion.

114. A method as in claim 112 whereby said method includes making the pre-cuts adjacent to the pull-strip.

115. A method as in claim 112 whereby said method includes making the spacing between the pre-cuts about the same width as the pull-strip.

116. A method as in claim 112 whereby said method includes making two pair of pre-cuts in the layer of tear-able material of the main body portion and whereby one pair of the pre-cuts is located at each end of the layer of tear-able material of the main body portion.

117. A method as in claim 112 whereby a seal-insert has a first surface and a second surface; and whereby said method includes attaching the layer of tear-able material to the first surface of the seal-insert; and whereby the seal-insert is rectangular in shape; and whereby the seal-insert has an open region.

118. A method as in claim 117 whereby said method includes manufacturing the seal-insert using a tape material that is pressure sensitive on both first surface and on second surface.

119. A method as in claim 117 whereby a pull-strip comprises a free length portion of tear-able material which is unitary with the layer of tear-able material.

120. A method as in claim 117 whereby the pull-strip comprises a tear-guide.

121. A method of manufacturing a toner cartridge assembly used in an image forming apparatus;

whereby said method includes a step of assembling a toner hopper and a photoreceptor housing to make a toner cartridge assembly; and whereby the photoreceptor housing includes a photoreceptor, a cleaning blade and a charging device for electrostatically charging the photoreceptor; and whereby the toner hopper includes a reservoir and a feed roller compartment; and whereby the reservoir is used to store a powdered toner; and whereby the feed roller compartment has a roller used to dispense the powdered toner; and whereby the toner hopper includes a seal assembly between the reservoir and the feed roller compartment; and whereby said method includes the step of manufacturing the seal assembly; and whereby the seal assembly includes a pull-strip and a layer of tear-able material; and whereby said method includes the step of manufacturing a pull-strip; and whereby said method also includes the step of making a main body portion including the layer of tear-able material, where the tear-able material includes a connecting region proximately located where the pull-strip is attached to the main body portion; and whereby said method also includes the step of forming a first pre-cut and a second pre-cut proximately located in the connecting region, whereby the first and second pre-cuts determine a location of an initial tear of the layer of tear-able material in the main body portion; and whereby said method includes the step of attaching the seal assembly to the toner hopper; and whereby said method includes a step whereby the pull-strip is made conductive either by impregnating conductive material into the pull-strip or by coating the pull-strip with a conductive coating.

122. A method of manufacturing a toner cartridge assembly used in an image forming apparatus;

whereby said method includes a step of assembling a toner hopper and a photoreceptor housing to make a toner cartridge assembly; and whereby the photoreceptor housing includes a a photoreceptor, a cleaning blade and a charging device for electrostatically charging the photoreceptor; and whereby the toner hopper includes a reservoir and a feed roller compartment; and whereby the reservoir is used to store a powdered toner; and whereby the feed roller compartment has a roller used to dispense the powdered toner; and whereby the toner hopper includes a seal assembly between the reservoir and the feed roller compartment; and whereby said method includes the step of manufacturing the seal assembly; and whereby the seal assembly includes a pull-strip and a layer of tear-able material; and whereby said method includes the step of manufacturing a pull-strip; and whereby said method also includes the step of making a main body portion including the layer of tear-able material, where the tear-able material includes a connecting region proximately located where the pull-strip is attached to the main body portion; and whereby said method also includes the step of forming a first pre-cut and a second pre-cut proximately located in the connecting region, whereby the first and second precuts determine a location of an initial tear of the layer of tear-able material in the main body portion; and whereby said method includes the step of attaching the seal assembly to the toner hopper; and whereby a seal-insert has a first surface and a second surface; and whereby said method includes attaching the layer of tear-able material to the first surface of the seal-insert; and whereby the seal-insert is rectangular in shape; and whereby the seal-insert has an open region; and whereby said method includes manufacturing the seal-insert using a permanent support plastic layer with two faces whereby each face is attached to a layer of tape, glue or adhesive.

123. A method of remanufacturing a toner cartridge assembly used in an image forming apparatus;

whereby said method includes a step of assembling a toner hopper and a photoreceptor housing to make a toner cartridge assembly; and whereby the photoreceptor housing includes a photoreceptor, a cleaning blade and a charging device for electrostatically charging the photoreceptor; and whereby the toner hopper includes a reservoir and a feed roller compartment; and whereby the reservoir is used to store a powdered toner; and whereby the feed roller compartment has a roller used to dispense the powdered toner; and whereby the toner hopper includes a seal assembly between the reservoir and the feed roller compartment; and whereby said method includes the step of manufacturing the seal assembly; and whereby the seal assembly includes a pull-strip and a layer of tear-able material; and whereby said method includes the step of making a pull-strip; and whereby said method also includes the step of making a main body portion including the layer of tear-able material, where the tear-able material includes a connecting region proximately located where the pull-strip is attached to the main body portion; and whereby said method also includes the step of forming a first pre-cut and a second pre-cut proximately located in the connecting region, whereby the first and second pre-cuts determine a location of an initial tear of the layer of tear-able material in the main body portion; and whereby said method includes the step of attaching the seal assembly to the toner hopper.

124. A method of remanufacturing as in claim 123 whereby said method includes making pre-cuts begin at one end of the main body portion.

125. A method of remanufacturing as in claim 123 whereby said method includes making the pre-cuts adjacent to the pull-strip.

126. A method of remanufacturing as in claim 123 whereby said method includes making the spacing between the pre-cuts about the same width as the pull-strip.

127. A method as in claim 123 whereby said method includes making two pair of pre-cuts in the layer of tear-able material of the main body portion and whereby one pair of the pre-cuts is located at each end of the layer of tear-able material of the main body portion.

128. A method as in claim 123 whereby a seal-insert has a first surface and a second surface; and whereby said method includes attaching the layer of tear-able material to the first surface of the seal-insert; and whereby the seal-insert is rectangular in shape; and whereby the seal-insert has an open region.

129. A method as in claim 128 whereby said method includes manufacturing the seal-insert using a tape material that is pressure sensitive on both first surface and on second surface.

130. A method as in claim 123 whereby a pull-strip comprises a free length portion of tear-able material which is unitary with the layer of tear-able material.

131. A method as in claim 123 whereby the pull-strip comprises a tear-guide.

132. A method of remanufacturing a toner cartridge assembly used in an image forming apparatus;

whereby said method includes a step of assembling a toner hopper and a photoreceptor housing to make a toner cartridge assembly; and whereby the photoreceptor housing includes a a photoreceptor, a cleaning blade and a charging device for electrostatically charging the photoreceptor; and whereby the toner hopper includes a reservoir and a feed roller compartment; and whereby the reservoir is used to store a powdered toner; and whereby the feed roller compartment has a roller used to dispense the powdered toner; and whereby the toner hopper includes a seal assembly between the reservoir and the feed roller compartment; and whereby said method includes the step of manufacturing the seal assembly; and whereby the seal assembly includes a pull-strip and a layer of tear-able material; and whereby said method includes the step of making a pull-strip; and whereby said method also includes the step of making a main body portion including the layer of tear-able material, where the tear-able material includes a connecting region proximately located where the pull-strip is attached to the main body portion; and whereby said method also includes the step of forming a first pre-cut and a second pre-cut proximately located in the connecting region, whereby the first and second precuts determine a location of an initial tear of the layer of tear-able material in the main body portion; and whereby said method includes the step of attaching the seal assembly to the toner hopper; and whereby said method includes a step whereby the pull-strip is made conductive either by impregnating conductive material into the pull-strip or by coating the pull-strip with a conductive coating.

133. A method of remanufacturing a toner cartridge assembly used in an image forming apparatus;

whereby said method includes a step of assembling a toner hopper and a photoreceptor housing to make a toner cartridge assembly; and whereby the photoreceptor housing includes a a photoreceptor, a cleaning blade and a charging device for electrostatically charging the photoreceptor; and whereby the toner hopper includes a reservoir and a feed roller compartment; and whereby the reservoir is used to store a powdered toner; and whereby the feed roller compartment has a roller used to dispense the powdered toner; and whereby the toner hopper includes a seal assembly between the reservoir and the feed roller compartment; and whereby said method includes the step of manufacturing the seal assembly; and whereby the seal assembly includes a pull-strip and a layer of tear-able material; and whereby said method includes the step of making a pull-strip; and whereby said method also includes the step of making a main body portion including the layer of tear-able material, where the tear-able material includes a connecting region proximately located where the pull-strip is attached to the main body portion; and whereby said method also includes the step of forming a first pre-cut and a second pre-cut proximately located in the connecting region, whereby the first and second pre-cuts determine a location of an initial tear of the layer of tear-able material in the main body portion; and whereby said method includes the step of attaching the seal assembly to the toner hopper; and whereby a seal-insert has a first surface and a second surface; and whereby said method includes attaching the layer of tear-able material to the first surface of the seal-insert; and whereby the seal-insert is rectangular in shape; and whereby the seal-insert has an open region; and whereby said method includes manufacturing the seal-insert using a permanent support plastic layer with two faces whereby each face is attached to a layer of tape, glue or adhesive.

* * * * *